US009101518B2

(12) United States Patent
Enriquez

(10) Patent No.: US 9,101,518 B2
(45) Date of Patent: Aug. 11, 2015

(54) IMPAIRED PERSON CARE SYSTEM AND METHOD

(71) Applicant: Leonel E. Enriquez, Melbourne Beach, FL (US)

(72) Inventor: Leonel E. Enriquez, Melbourne Beach, FL (US)

( * ) Notice: Subject to any disclaimer, the term of this patent is extended or adjusted under 35 U.S.C. 154(b) by 0 days.

(21) Appl. No.: 14/157,663

(22) Filed: Jan. 17, 2014

(65) Prior Publication Data

US 2014/0196207 A1 Jul. 17, 2014

Related U.S. Application Data

(60) Provisional application No. 61/753,708, filed on Jan. 17, 2013.

(51) Int. Cl.

| | |
|---|---|
| ***A61G 7/05*** | (2006.01) |
| ***A61G 7/053*** | (2006.01) |
| ***A61G 5/00*** | (2006.01) |
| ***A61G 5/10*** | (2006.01) |
| ***A61G 5/04*** | (2013.01) |
| ***A61G 7/015*** | (2006.01) |
| *A61G 5/12* | (2006.01) |
| *A61G 7/16* | (2006.01) |

(52) U.S. Cl.

CPC ..... *A61G 7/053* (2013.01); *A61G 5/006* (2013.01); *A61G 5/042* (2013.01); *A61G 5/1002* (2013.01); *A61G 5/1059* (2013.01); *A61G 7/015* (2013.01); *A61G 2005/125* (2013.01); *A61G 2007/0514* (2013.01); *A61G 2007/0516* (2013.01); *A61G 2007/165* (2013.01)

(58) Field of Classification Search

CPC ..... A61G 7/053; A61G 7/015; A61G 5/006; A61G 5/042; A61G 5/1002; A61G 5/1059; A61G 2005/125; A61G 2007/0514; A61G 2007/0516; A61G 2007/165

USPC ..... 5/611, 81.1 R, 2.1, 86.1, 83.1

See application file for complete search history.

(56) References Cited

U.S. PATENT DOCUMENTS

| | | | |
|---|---|---|---|
| 2,869,614 | A | 1/1959 | Wamsley |
| 3,038,174 | A | 6/1962 | Brown et al. |
| 3,215,469 | A | 11/1965 | Wamsley |
| 3,769,638 | A | 11/1973 | Clanan |
| 4,067,409 | A | 1/1978 | DiMatteo et al. |
| 4,266,305 | A | 5/1981 | Kavaloski et al. |
| 4,679,259 | A | 7/1987 | DiMatteo et al. |
| 4,700,415 | A | 10/1987 | DiMatteo et al. |
| 4,949,408 | A | 8/1990 | Trkla |
| 5,380,034 | A | 1/1995 | Wilson |

(Continued)

*Primary Examiner* — Peter M Cuomo
*Assistant Examiner* — Brittany Wilson
(74) *Attorney, Agent, or Firm* — Edell, Shapiro & Finnan, LLC

(57) ABSTRACT

An impaired person care system which includes a reconfigurable powered wheelchair operating in conjunction with a segmented bed having a main bed section and multiple reconfigurable bed sections. The wheelchair has back, seat and leg sections configurable to an upright sitting position or a horizontal lying-down bed resting position. In the sitting position the wheelchair is positionable over a regular commode; in the lying-down position the wheelchair is positionable on the multiple reconfigurable bed sections and movable vertically in response to corresponding movement of the reconfigurable bed sections to the level of the main bed section. The wheelchair also has an opening in the seat section with allowing unobstructed passage of fecal waste from bowel movements when the wheelchair is positioned over the commode.

26 Claims, 30 Drawing Sheets

(56) References Cited

U.S. PATENT DOCUMENTS

| | | | | |
|---|---|---|---|---|
| 5,577,753 | A | 11/1996 | Pociask | |
| 6,540,250 | B1 | 4/2003 | Peterson | |
| 6,547,265 | B1 | 4/2003 | Enge et al. | |
| 6,839,918 | B1 | 1/2005 | Jensen | |
| 6,976,278 | B2 | 12/2005 | Oetting et al. | |
| 7,793,364 | B1 | 9/2010 | Johnson et al. | |
| 8,117,696 | B2 | 2/2012 | Wernqvist et al. | |
| 8,544,866 | B2 * | 10/2013 | Noonan et al. | 280/304.1 |
| 2002/0020987 | A1 | 2/2002 | Coleman | |
| 2010/0199422 | A1 | 8/2010 | Patwardhan | |
| 2012/0159705 | A1 | 6/2012 | Tsukada et al. | |
| 2012/0297542 | A1 | 11/2012 | Chun et al. | |
| 2013/0074256 | A1 * | 3/2013 | Tsukada et al. | 5/81.1 R |
| 2013/0134757 | A1 | 5/2013 | Hines | |

* cited by examiner

IMPAIRED PERSON CARE SYSTEM AND METHOD

CROSS-REFERENCE TO RELATED APPLICATIONS

This application claims priority under 35 U.S.C. §119(e) to U.S. Provisional Application No. 61/753,708, entitled Impaired Person Care System, filed Jan. 17, 2013. The disclosure of this provisional patent application is incorporated herein by reference in its entirety.

FIELD OF THE INVENTION

The present invention pertains generally to wheelchairs convertible to beds, and vice versa. More particularly, the invention pertains to improvements in wheelchair-bed apparatus and methods that permit bed-ridden patients to more readily maneuver themselves from a bed to a lavatory facility.

BACKGROUND OF THE INVENTION

In most developed countries of the world, the cost for care of the elderly is expected to rise dramatically in the near future due to the increasing number of elderly people. Statistics show that in the U.S. alone 610,000 people will suffer a stroke for the first time every year and approximately 203,000 of them will remain permanently disabled. Worldwide, the corresponding number of disabled individuals is estimated at 5 million. For these persons, major care-giving issues include general hygiene, of which the most challenging tasks usually arise while assisting them with the elimination of urinary and fecal waste. Thus, it is becoming increasingly important to focus attention on the means for caring for those who become weak or physically impaired.

Solutions to these long-term challenges are provided by assisted living facilities and nursing homes, but the costs associated with these services are essentially unaffordable by non-affluent individuals. A much preferred solution, both financially and psychologically, would be to provide effortless and attractive care by relatives in the home environment.

Weak and physically impaired individuals usually require a substantial amount of assistance to transfer from a bed to a wheelchair and from a wheelchair to a commode. Under severe conditions such assistance requires an inordinate amount of strength, which the caregiver may be physically unable or unwilling to provide.

Many designs have been provided in the prior art for impaired patient assistance. Even though those designs may be suitable for the individual purposes addressed, they are unsuitable for the purposes of the present invention.

For example, U.S. Pat. No. 8,117,696 (Wernqvist et al.) discloses an articulated bed arrangement that is convertible from a bed configuration to a chair configuration and provides for an height adjustment relative to the floor. However, the arrangement does not provide for conversion to a powered wheelchair, the comfort of a real mattress when in the sleep configuration, compatible transportation to a toilet, or the pertinent positioning and seat opening for bowel movements.

Another example is U.S. Pat. No. 4,949,408 (Trkla). This patent discloses a powered wheelchair configurable to three positions: sitting vertically, sitting with feet elevated and lying down horizontally. However, the arrangement does not provide for the comfort of a real mattress when in the horizontal configuration and does not allow over-the-toilet positioning of the wheelchair as required for bowel movements.

The patent acknowledges the requirement for transferring the impaired person from a bed to the wheelchair and vice-versa.

A further example is provided by U.S. Pat. No. 4,067,409 (DiMatteo, et al.). While this patent discloses a powered wheelchair that provides compatible transportation to the toilet, pertinent positioning over the toilet and a seat opening for bowel movements, the arrangement does not provide for a bed configuration and requires transfer of the patient to a bed. This latter aspect could present significant challenges for the caregiver.

Thus, there is a need for a reconfigurable comfortable bed and powered wheelchair arrangement that can be used at home or in assisted living and nursing home environments to provide effortless transfer of an individual with impaired physical capabilities from a comfortable lying-down bed resting position to a sitting position over a standard or conventional toilet for unobstructed bowel movements, and thereafter to provide transfer of the individual back to the original lying-down bed resting position. Such an arrangement would greatly facilitate the tasks required from caregivers, with a corresponding reduction in required physical strength and/or financial burden.

SUMMARY OF THE INVENTION

The present invention is directed to an impaired person care system comprising a reconfigurable powered wheelchair and a segmented bed composed of multiple reconfigurable bed sections. The wheelchair features a patient support area of bedlike size comprising a back section, a seat section and a leg section. The wheelchair is capable of being positioned over a standard toilet or commode, as well as over at least one reconfigurable bed section of the segmented bed. Such capability is enabled by minimization of on-board operating components, appropriate positioning of bulky power components to the bottom-side portions of the wheelchair, and complete clearing of the required space volume under the central portion of the seat section of the wheelchair. The patient support area of the wheelchair can be configured to either an upright sitting position or to a horizontal lying-down bed resting position. When in the bed resting position, the patient support area can move vertically in response to corresponding movement of reconfigurable sections of the segmented bed. The wheelchair also features a suitable toilet access aperture in the seat section which allows unobstructed passage of fecal waste from bowel movements when the wheelchair is positioned over a toilet or commode.

Accordingly, it is an object of the present invention to provide physically impaired individuals with a virtually seamless and reversible capability to re-position from a comfortable lying-down bed resting position to a sitting position over a standard toilet for unobstructed bowel movements, and re-position back to their original lying-down bed resting position.

It is another object of the present invention to provide a reconfigurable comfortable bed and powered wheelchair arrangement with means for adjusting the leg and back sections of the wheelchair from a lying-down bed resting position to a sitting position and vise versa.

It is a further object of the present invention to provide a reconfigurable powered wheelchair arrangement with locomotive means to facilitate movement of the wheelchair by a patient to and from a position over a standard toilet for unobstructed bowel movement.

It is still a further object of the present invention to provide a reconfigurable motorized wheelchair with power and mechanical system components mounted under a seat section of the wheelchair in a manner that provides for complete clearance of the required access space volume under an opening in the seat section to enable the wheelchair to be positioned over a standard toilet for unobstructed bowel movements by a patient and over at least one reconfigurable bed section of a segmented bed for providing a comfortable lying-down rest position for the patient.

It is another object of the present invention to provide a comfortable segmented bed having a main bed section and a set of reconfigurable bed sections that work in conjunction with a reconfigurable powered or motorized wheelchair to re-position physically disabled individuals from a comfortable lying-down bed resting position to a sitting position, and further assists in the return of the patient to their original lying-down bed resting position.

The aforesaid objects are achieved individually and in combination, and it is not intended that the present invention be construed as requiring two or more of the objects to be combined unless expressly required by the claims attached hereto.

The above and still further objects, features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DETAILED DESCRIPTION OF THE PREFERRED EMBODIMENT

Figure 1A:
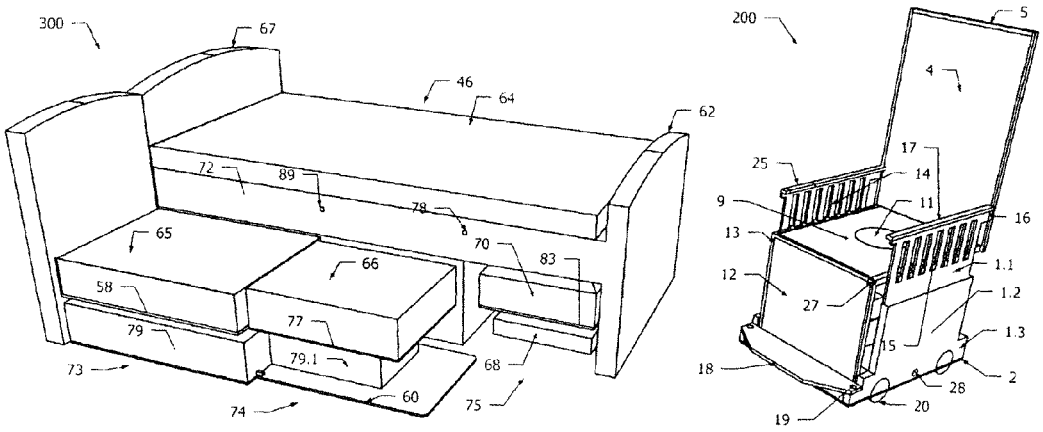
FIG. 1A is a perspective view of the impaired patient care system of the present invention showing the segmented bed with reconfigurable bed sections and the reconfigurable powered wheelchair separated from the reconfigurable bed sections.

The impaired person care system of the present invention comprises a specially configured powered or motorized wheelchair 200 and a specially configured segmented bed 300 with three reconfigurable bed sections 73, 74, and 75, as shown in FIG. 1A.

Figure 1B:
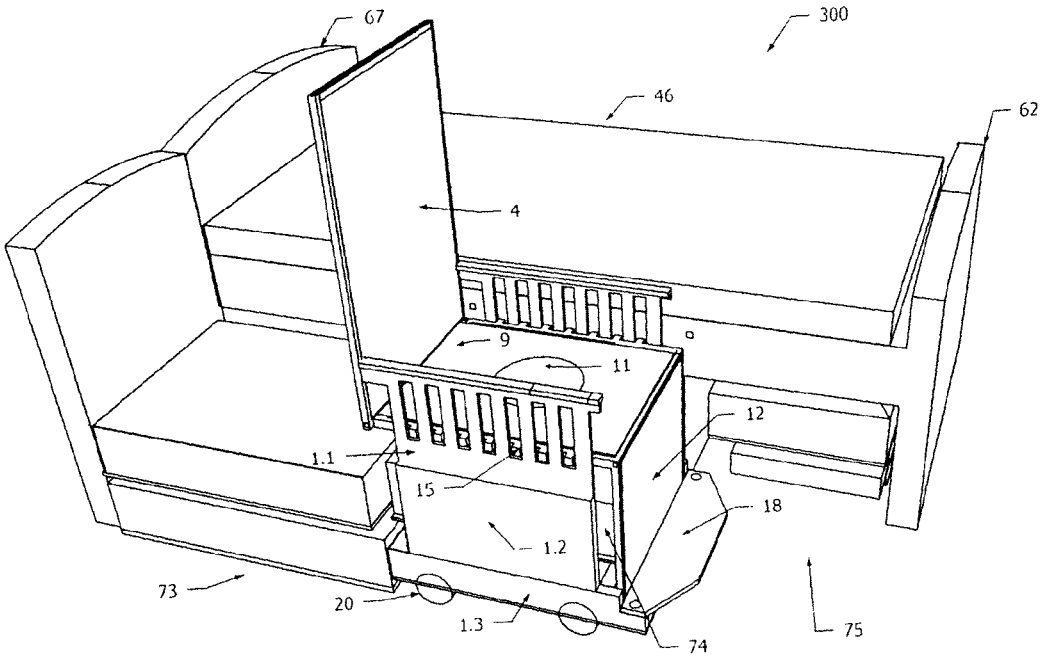
FIG. 1B is a perspective view of the impaired patient care system of the present invention showing the reconfigurable powered wheelchair in its sitting configuration and positioned over one of the reconfigurable bed sections set at its low height setting.
Figure 1C:
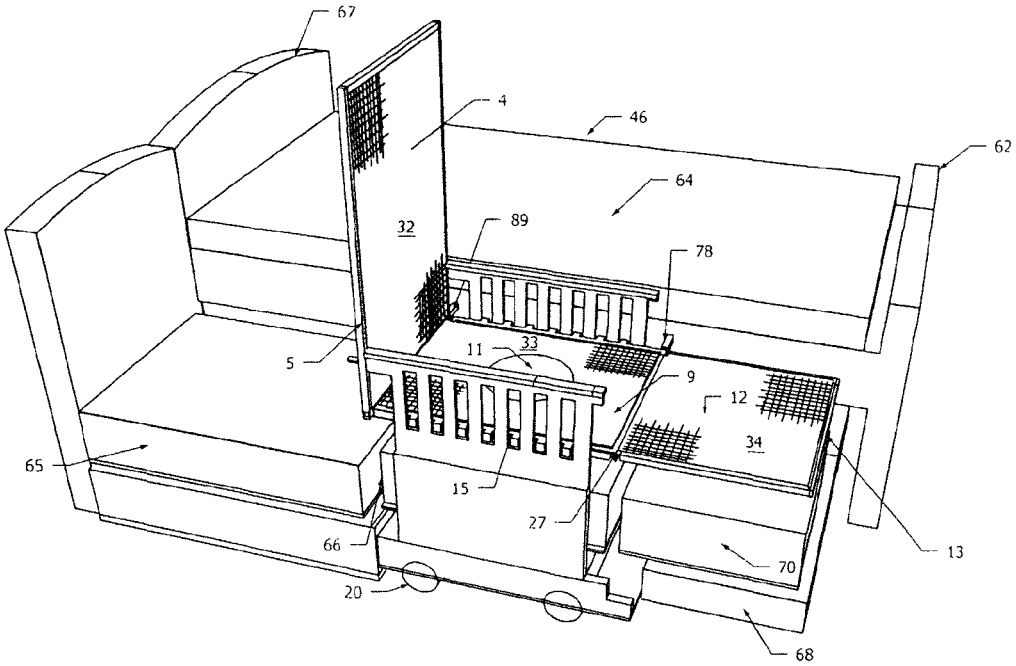
FIG. 1C is a perspective view of the impaired patient care system of the present invention showing the reconfigurable powered wheelchair in an intermediate sitting/leg extending configuration and positioned over two of the reconfigurable bed sections set at their low height settings.
Figure 1D:
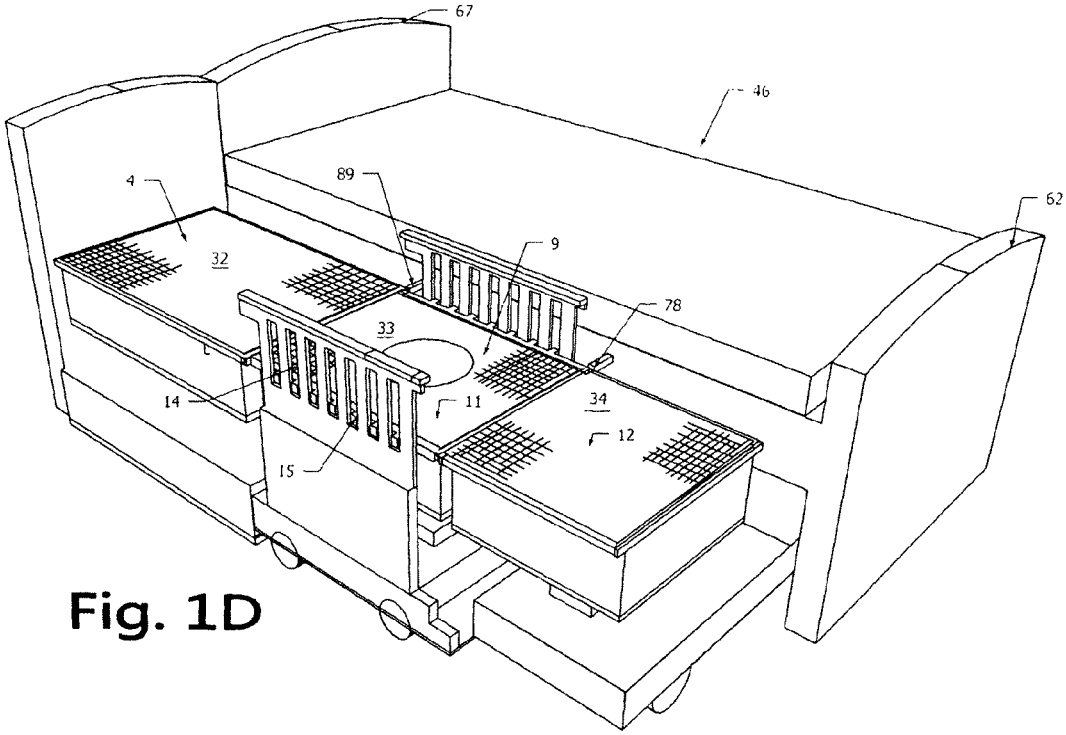
FIG. 1D is a perspective view of the impaired patient care system of the present invention showing the reconfigurable powered wheelchair in its lying-down bed resting configuration and positioned over all the reconfigurable bed sections set at their intermediate height setting.
Figure 2:
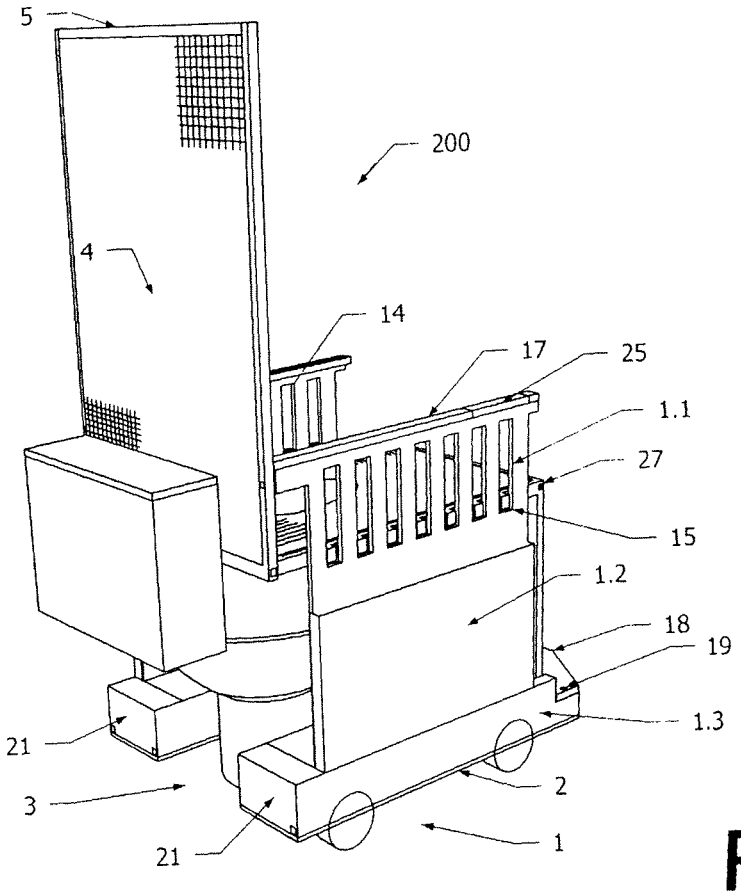
FIG. 2 is a perspective view of the reconfigurable powered wheelchair of the present invention positioned over a conventional or standard toilet or commode.

The powered or motorized wheelchair 200 features a lower compartment 3 that is specifically configured to be dimensionally compatible with being positioned directly over a toilet, as shown in FIG. 2, and over suitable reconfigurable bed sections 73, 74, and 75, as shown in FIGS. 1D and 23-25. Such compatibility is enabled by novel minimization of on-board operating components, positioning of bulky power components in a specially configured compartment 21 located under a seat section 9 of the wheelchair and a complete clearing of the required access space volume in the compartment 3 under the seat section 9 of the wheelchair. To achieve complete clearing of the required space volume in compartment 3, the specially configured compartment 21 is positioned adjacent the lower periphery of the wheelchair frame 1, as shown in FIG. 2. Furthermore, to accommodate a standard toilet or commode, the access space should have a width and height of at least 14 inches.

Figure 3:
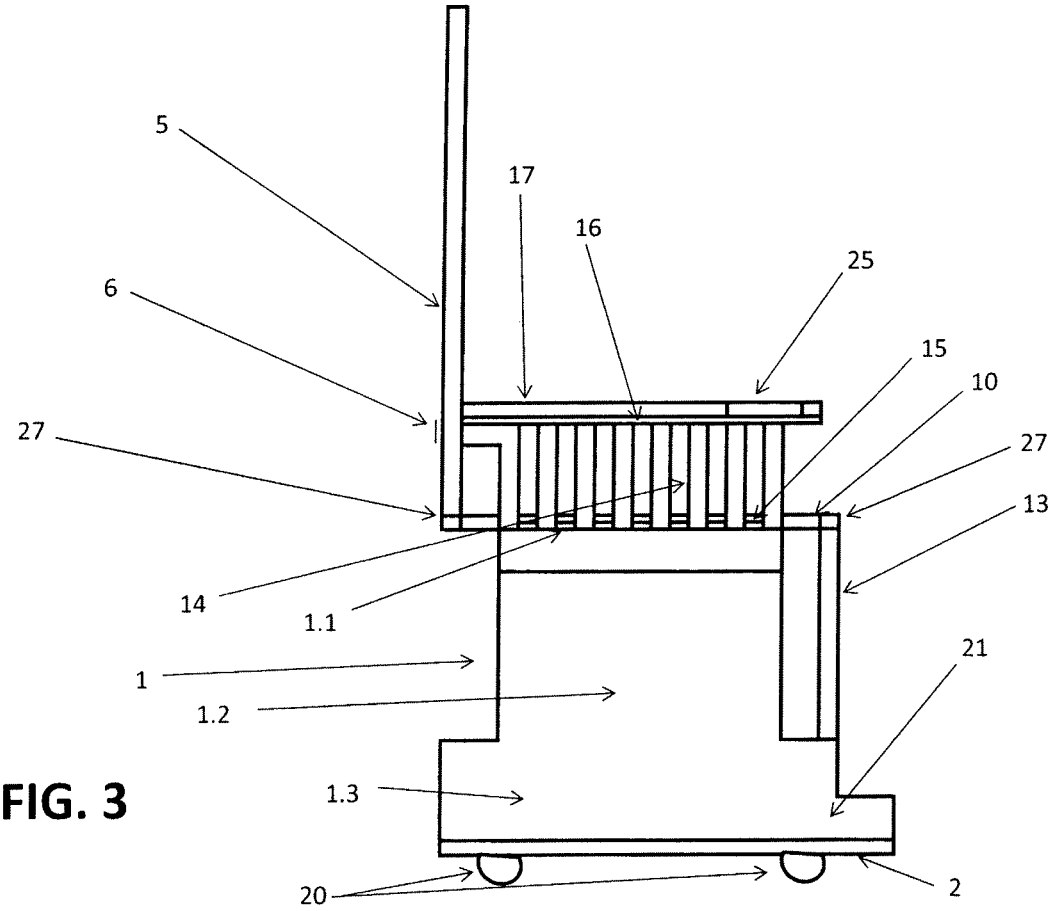
FIG. 3 is a side view of the reconfigurable powered wheelchair of the present invention in the upright sitting position with the footrest removed.

The structural integrity of the wheelchair is mainly provided by the frame 1 and a U-shaped removable bottom plate 2. The frame 1 of the wheelchair includes an upper portion 1.1, a middle portion 1.2, and a lower portion 1.3, as shown in FIGS. 1A, 2 and 3. The upper portion 1.1 of the frame is provided with elongated openings or slots 14 for allowing upward and downward movement of the seat section 9.

Figure 10:
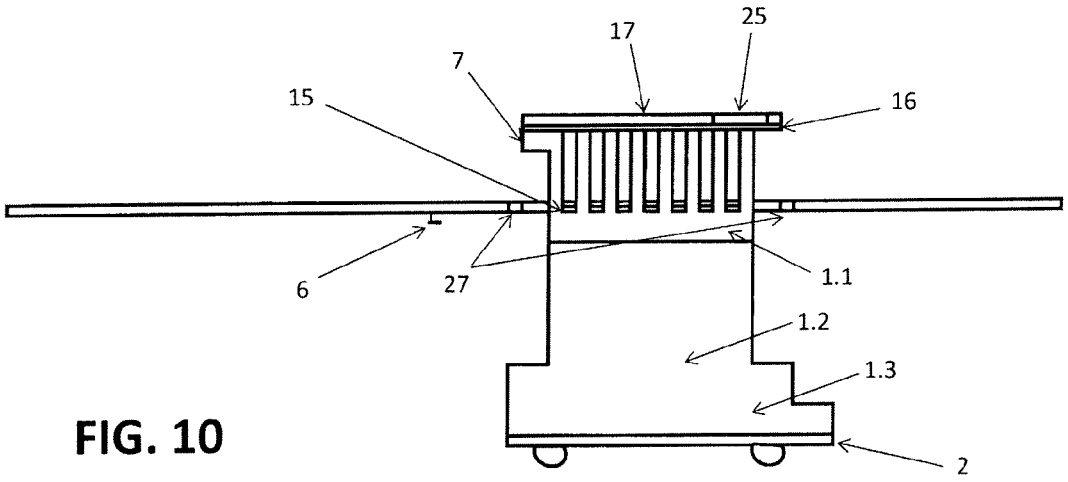
FIG. 10 is a side view of the reconfigurable powered wheelchair of the present invention showing the patient support area in the horizontal lying-down resting position.
Figure 11:
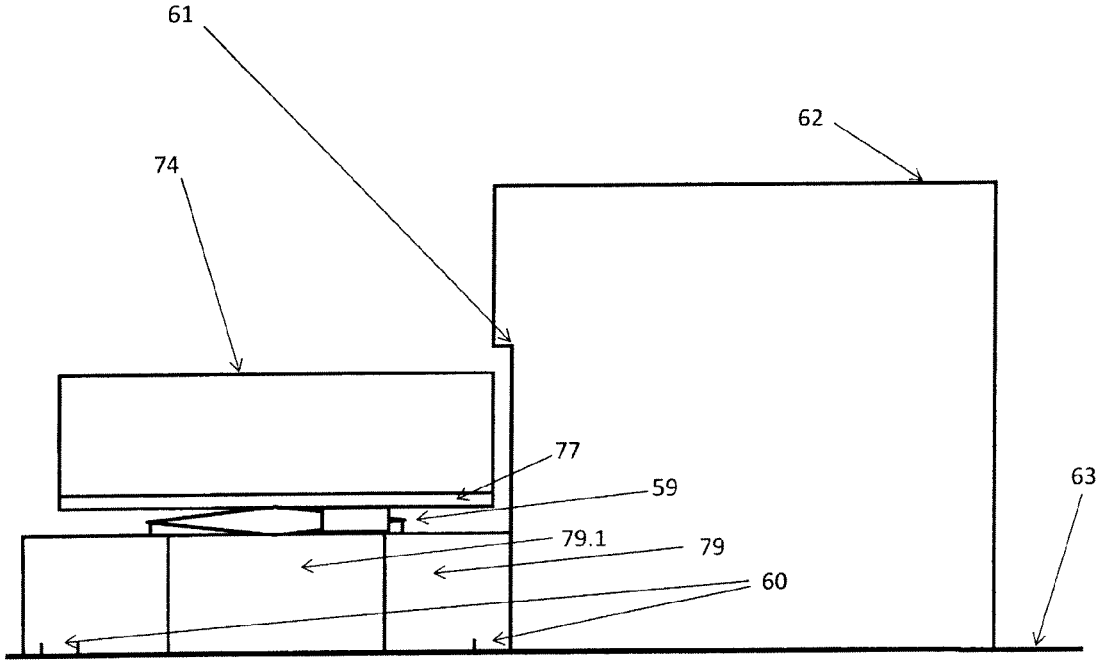
FIG. 11 is a front view of the segmented bed of the present invention showing the upper and middle reconfigurable bed sections set at their low height settings prior to deployment of the lower reconfigurable bed section.

The back section 4, seat section 9 and leg section 12 of the wheelchair (shown in FIG. 1A) define a patient support area. The patient support area of the wheelchair can be configured to either an upright sitting position, as shown in FIGS. 1A, and 3, or a horizontal lying-down resting position, as shown in FIGS. 1E and 10. Comfortable sitting or resting positions are deployed by the relative positioning of the three sections of the patient support area, namely, back section 4, seat section 9 and leg section 12 together with their relative interactions with their corresponding reconfigurable bed sections 73, 74, and 75. The chair frame 1 is responsible for the primary structural support of the seat section 9, as described in detail below.

Figure 4B:
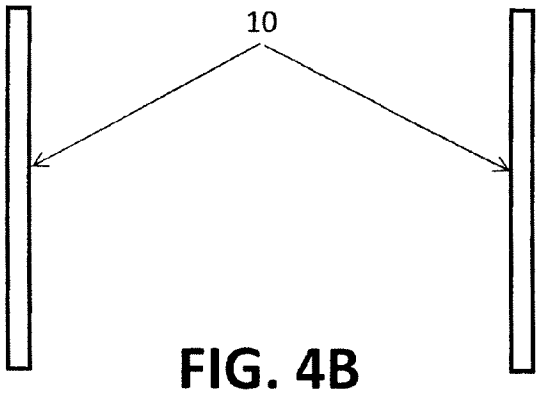
FIG. 4B is a top view of the square cross-section rods and rod frame configuration which defines the structural outer boundaries of the seat section of the power wheelchair of the present invention.
Figure 4C:
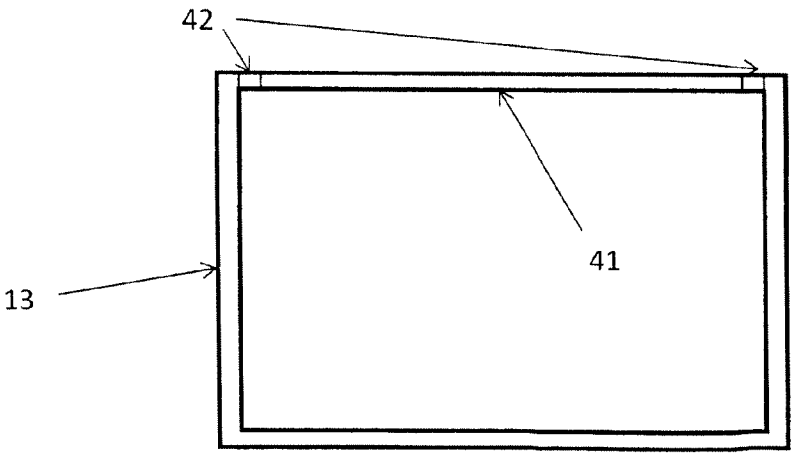
FIG. 4C is a front view of the square cross-section rods and rod frame configuration which defines the structural outer boundaries of the leg section of the power wheelchair of the present invention.
Figure 4A:
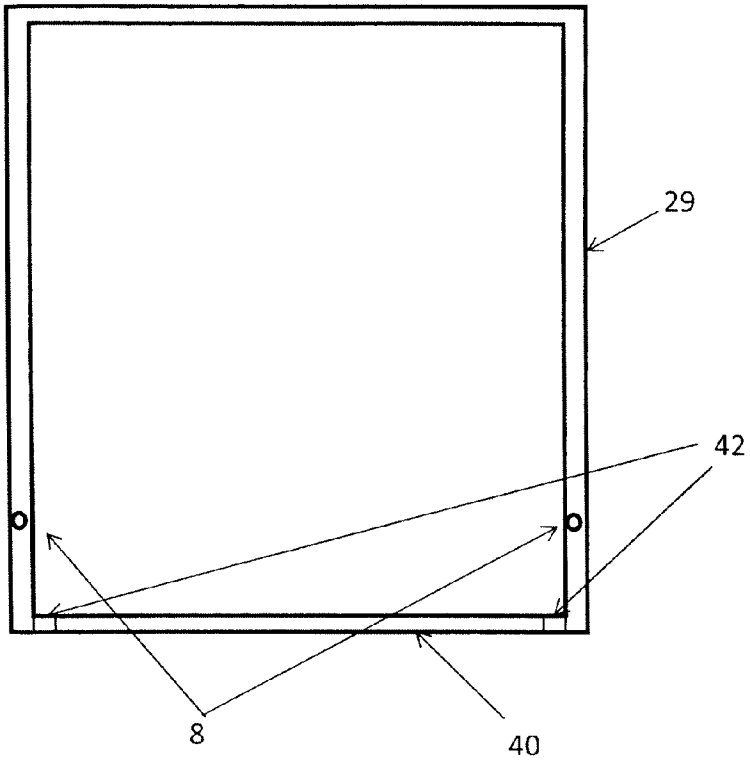
FIG. 4A is a front view of the square cross-section rods and rod frame configuration which defines the structural outer boundaries of the back section of the powered wheelchair of the present invention.
Figure 17:
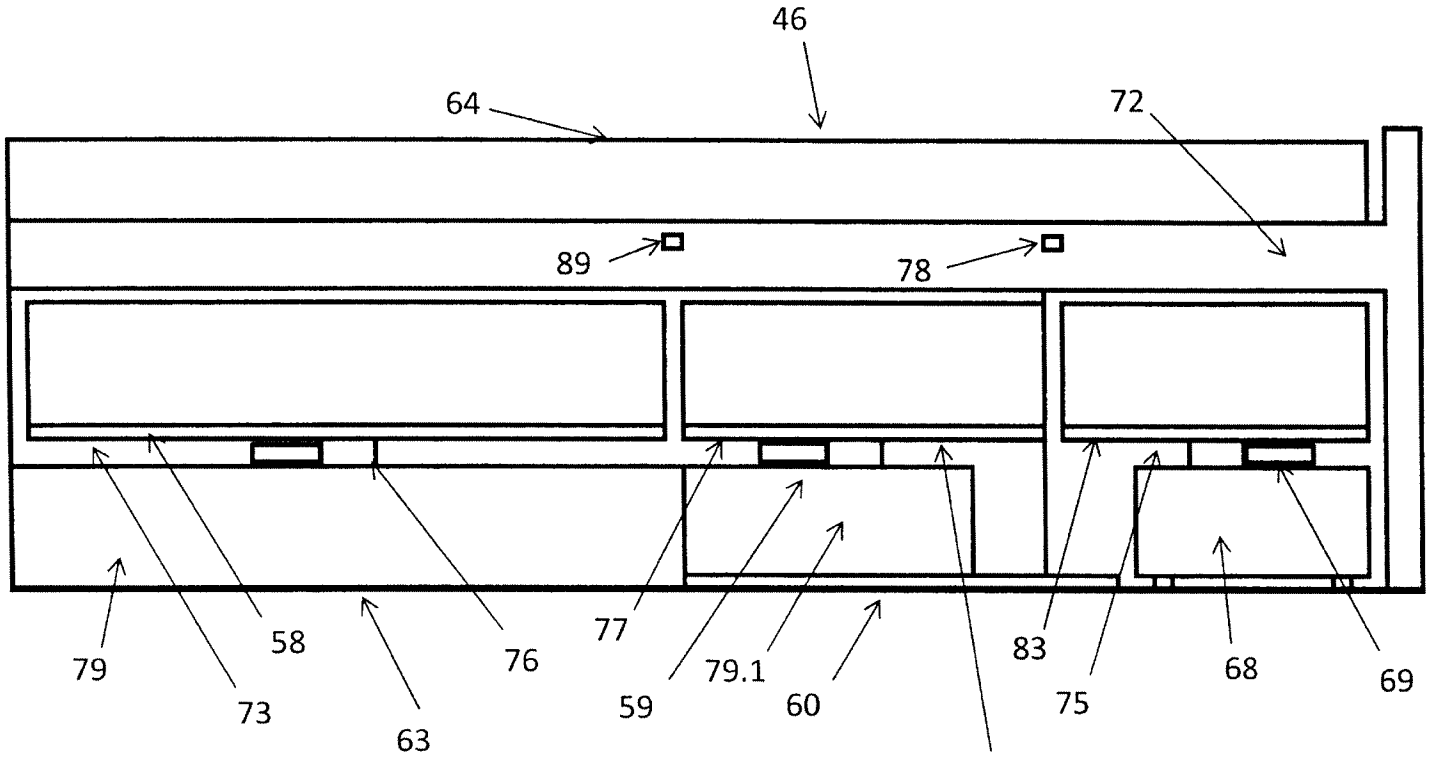
FIG. 17 is a side view of the segmented bed of the present invention showing the upper, middle and lower reconfigurable bed segments positioned at their low height settings before or after the lower reconfigurable bed is deployed.

The seat section 9 is comprised of two horizontal metal rods 10 coupled to the back section rod frame 29 and the leg section rod frame 13, as shown in FIGS. 4A-4C. The coupling point 42 of the rods 10 to the back section rod frame 29 and the leg section rod frame 13 (FIGS. 4A and 4C) is such that the back section 4 and leg section 12 can be rotated or pivoted about a pivot axis to either a horizontal or a vertical position. Rotation is accomplished in response to motorized rotational couplers 78, 89 (FIGS. 1C, 1E and 13) acting on the wheelchair coupler access openings 27 (FIGS. 1A, 1C and 3). The cross-section of the rotational couplers 78, 89 (FIG. 17) matches the square cross-section of the coupler access openings 27 (see FIG. 3).

The motorized rotational couplers 78, 89 are retractable to allow unimpeded wheelchair movements whenever necessary. The preferred embodiment utilizes an electromagnetic plunger structure (FIGS. 14A, 14B) whose housing 96 is firmly attached to structural supports 97 inside the base bed frame 72. Additionally, rotation of the back section rod frame 29 and the leg section rod frame 13 should be limited so as to not extend beyond a horizontal position; this ensures a predictable rotation range for the coupler access openings 27. Limiting rotation of the back section rod frame 29 and the leg section rod frame 13 is important to ensure that the coupler access openings 27 maintain a fixed rotational setting while the back section 4, seat section 9 and leg section 12, which define the patient support area, rest over their corresponding mattresses 65, 66, 70. By way of example, providing a rotation tab on the lower horizontal rod of the back section frame and on the upper horizontal rod of the leg section frame in conjunction with a rotation groove at the ends of at least one of the seat section rods may be used to limit the rotational range of the back and leg sections.

Figure 1E:
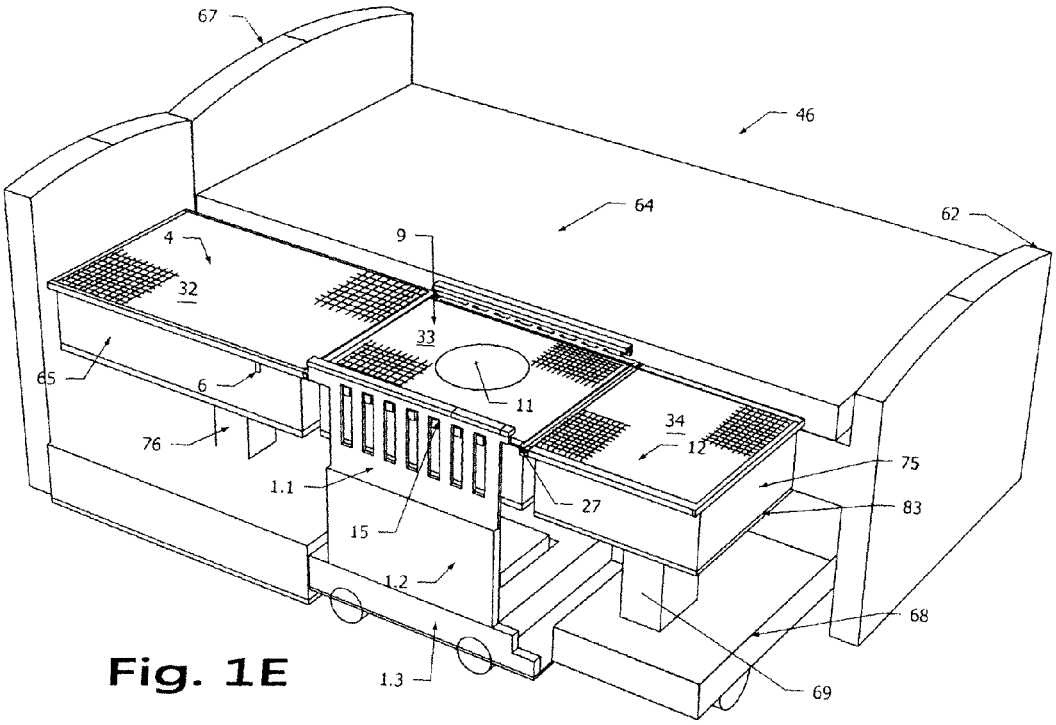
FIG. 1E is a perspective view of the impaired patient care system of the present invention showing the reconfigurable powered wheelchair in its lying-down bed resting configuration and positioned over all the reconfigurable bed sections set at their high height setting.
Figure 8:
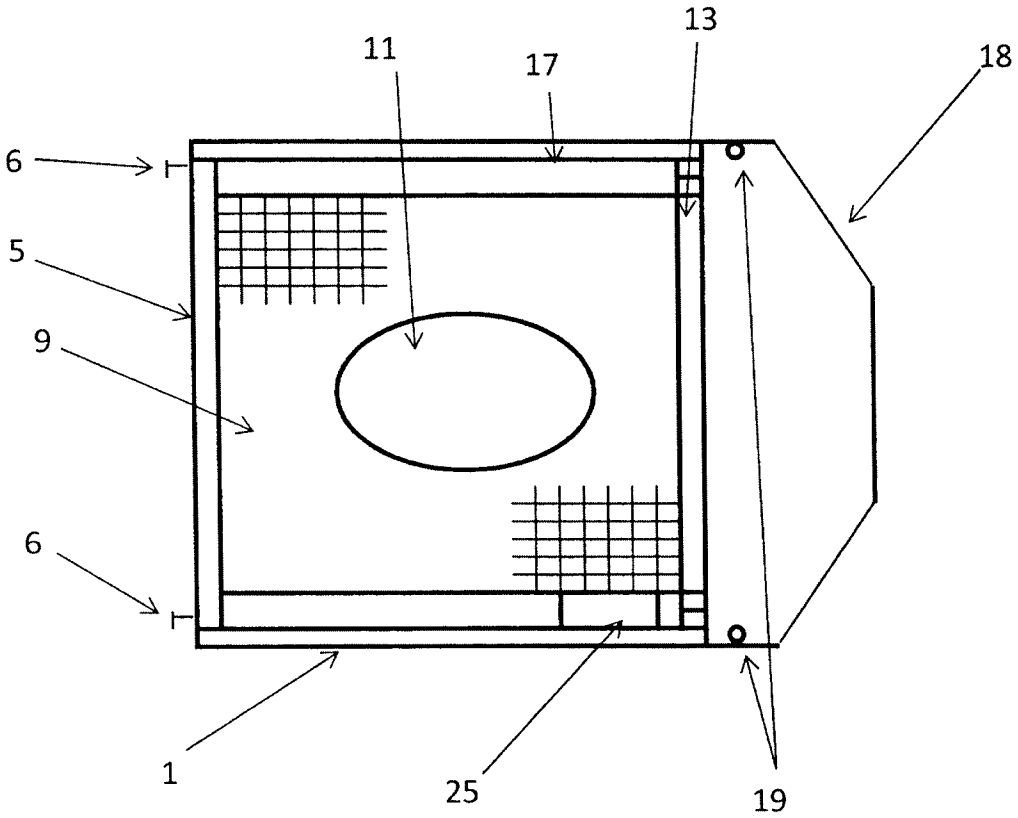
FIG. 8 is a top view of the reconfigurable powered wheelchair of the present invention in the upright seating position with the footrest attached and locked.

The rods 5, 10, 13 of the back, seat, and leg sections support soft, cushioned material 32, 33, 34, such as leather or synthetic leather and fabric material (see FIG. 1C-1D). The soft, cushioned material defines the sitting and lying-down bed resting areas in contact with the patient. If desired, the soft, cushioned material in the seat area may have support structure positioned below the soft, cushioned material, such as padded plywood or other suitable reinforcing material. The soft, cushioned material may be removably secured to the rods 5, 10, 13 using any suitable fastening means. The material defining the seat section 9 has a toilet access aperture or opening 11 (FIG. 8) defined therethrough which allows for unobstructed patient bowel movements when the wheelchair is properly positioned with the access aperture vertically aligned over a toilet, as shown in FIG. 2. The wheelchair is to be positioned over the toilet with the toilet seat down. The access aperture of the chair is dimensionally commensurate with the toilet seat opening. Thus, any splashing will be shielded by either the toilet seat or the patient's bottom. However, should cleaning become necessary, at least one product is commercially available that has the shape of a toilet seat (in fact it is a toilet seat) and provides water cleaning and air drying of the person's bottom, as well as a self cleaning cycle after every use. As for the toilet seat, the bottom of the seat is to be cleaned by a caregiver when necessary as is the case with any conventional toilet seat.

Figure 5B:
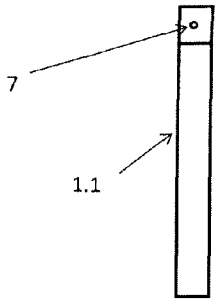
FIG. 5B is a rear view of the upper frame portion of the wheelchair of the present invention showing the attachment hole for the latching mechanism which secures the back section in its upright position.
Figure 5A:
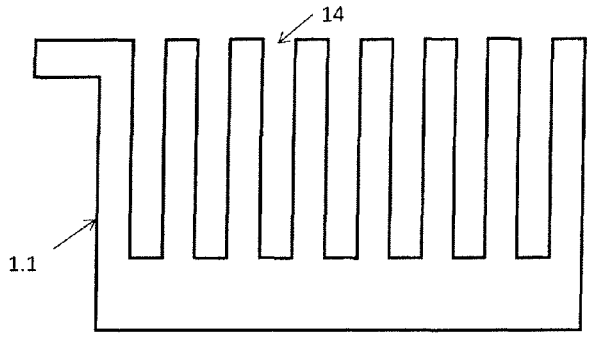
FIG. 5A is a side view of the upper frame portion of the wheelchair of the present invention.
Figure 5C:
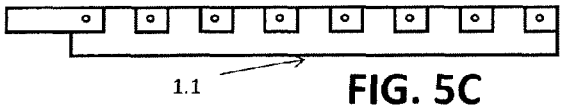
FIG. 5C is a top view of the upper frame portion of the wheelchair of the present invention showing the attachment holes for securing the cap assembly.
Figure 5D:
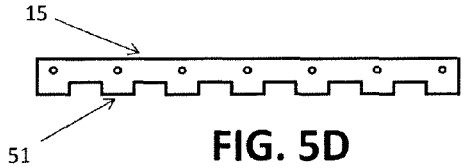
FIG. 5D is a top view of the interface flange which cooperates with the upper frame portion of the wheelchair of the present invention to provide seat section support and allow upward and downward movement of the seat section.
Figure 6:
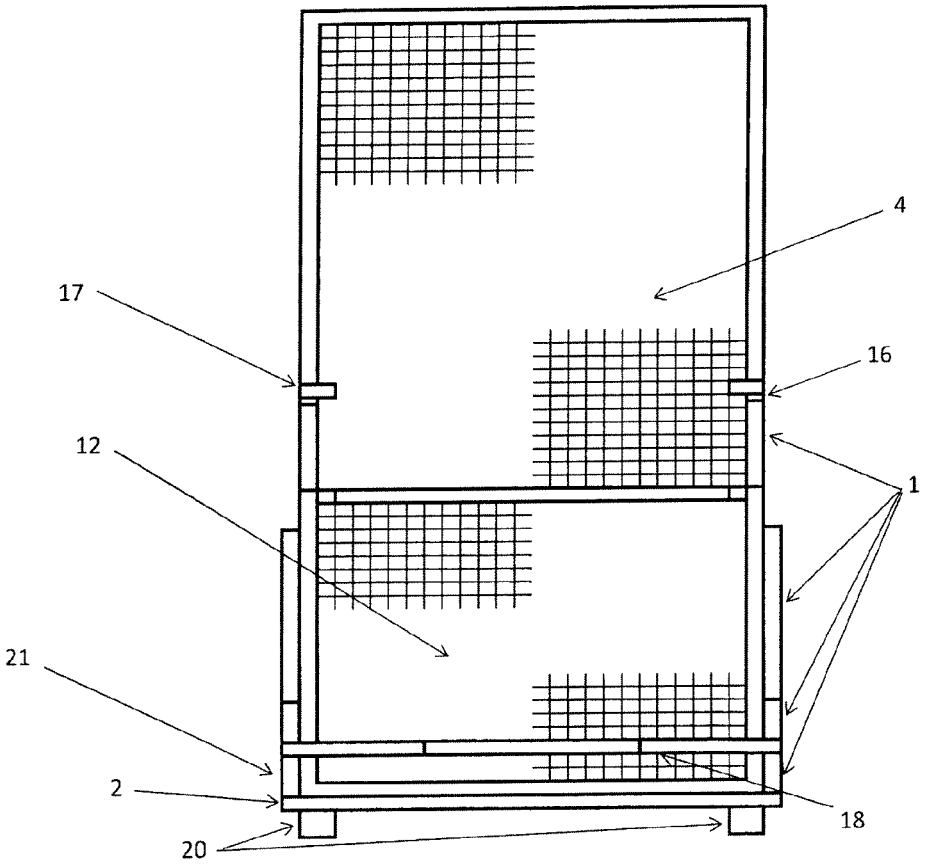
FIG. 6 is a front view of the reconfigurable powered wheelchair of the present invention in the upright sitting position with the footrest attached.

Additional support for the seat section 9 is provided by two interface flanges 15 (see FIGS. 1A-1D and 3). The flanges have a toothed or comb-like configuration 51, as shown in FIG. 5D, and are designed to attach to the rods 10 of the seat section. The "teeth" of the flanges extend through the openings 14 in the upper frame portion 1.1 of the wheelchair and rest at the bottom of the openings when external means do not provide for patient support, as shown in FIGS. 1A-1C, 3 and 10. The flange "teeth" provide guidance for upward and downward seat section movement within the boundaries of the frame openings 14. Because of the previously described coupling 42 of the back section 4 and leg section 12 to the rods 10, the back and leg sections are capable of being shifted upwardly and downwardly with the seat section 9.

The openings 14 in the upper frame portion 1.1 of the wheelchair are capped by two removable sets of components: a seat assembly cap 16 and an armrest 17 (FIGS. 1A and 3). The assembly cap 16 and the armrest 17 may be attached to the upper frame portion 1.1 using, for example, screws or other suitable fasteners. This arrangement allows for independent assembly of the back/seat/leg sections of the wheelchair from the frame 1. A system command controller 25 is housed in one of the armrests 17 (see FIGS. 1A, 3 and 8). The command controller is operated by either the patient or the caregiver to issue commands to various components of the configurable bed system.

Figure 7:
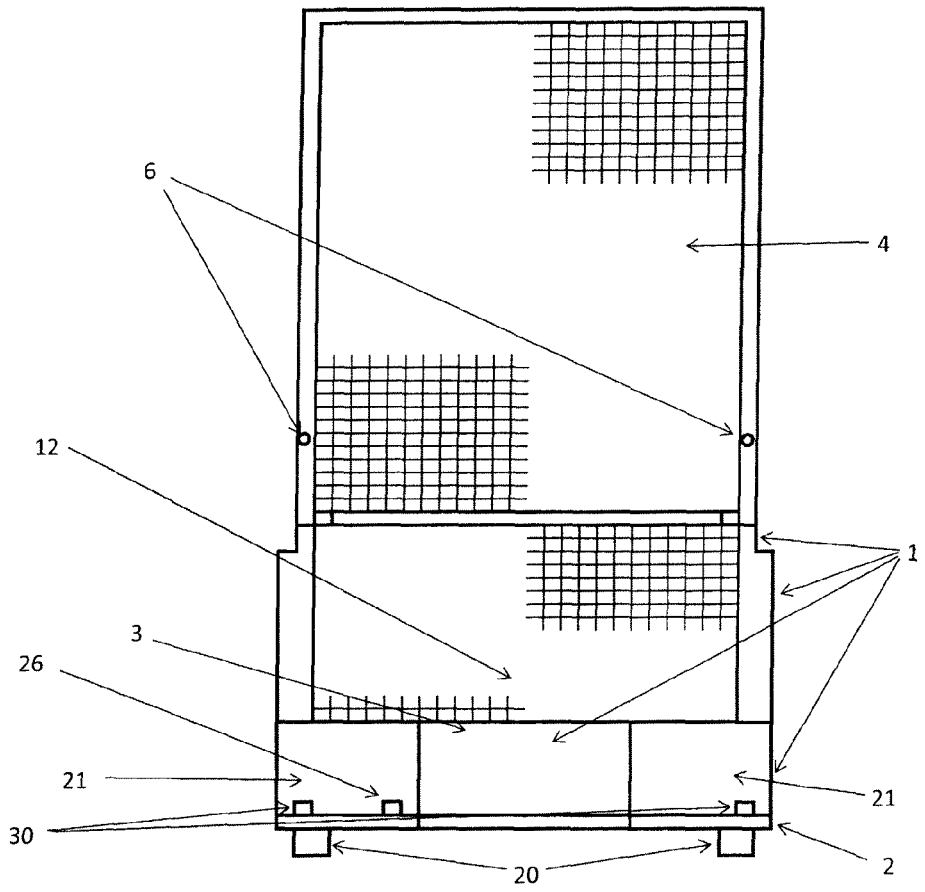
FIG. 7 is a rear view of the reconfigurable powered wheelchair of the present invention in the upright sitting position showing the openings providing access to the power management module connector and the securing and aligning pins.
Figure 9:
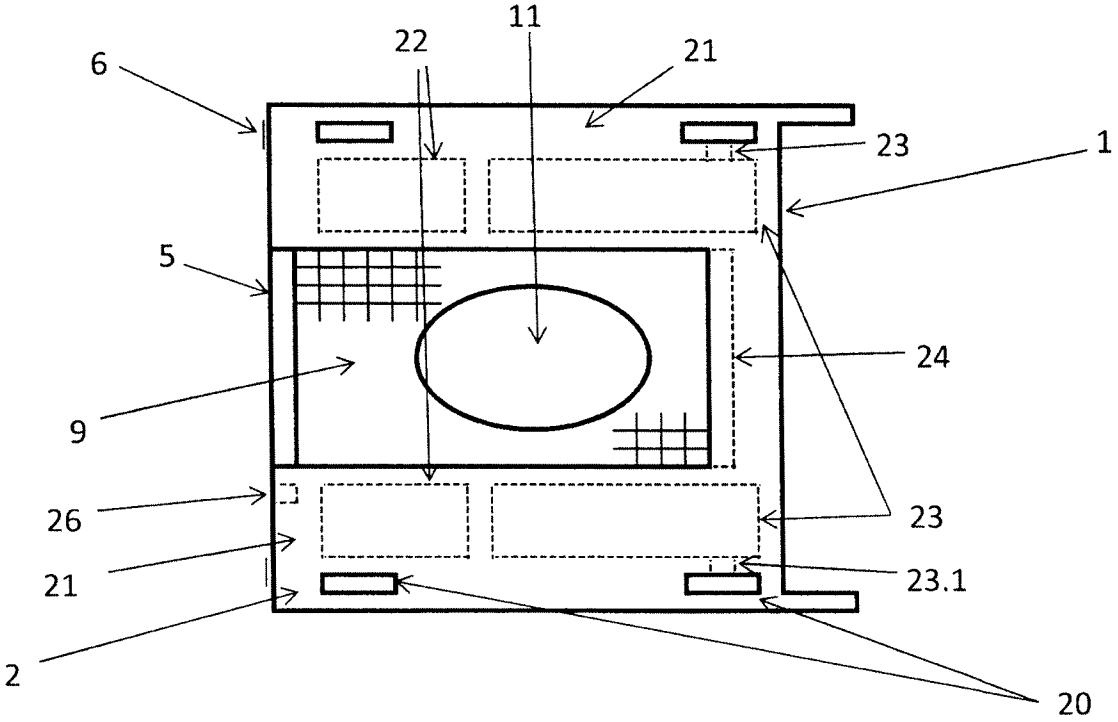
FIG. 9 is a bottom view of the configurable powered wheelchair of the present invention showing the footrest removed and the wheelchair power mechanisms at their relative placement locations in the lower compartment of the wheelchair in phantom.

The specially configured compartment 21 houses the locomotion components of the wheelchair (FIGS. 2, 7, and 9). A preferred embodiment features two 12-volt batteries 22, two 24-volt wheelchair motors 23, a steering controller 24 and four wheels 20 (two front wheels and two back wheels). All of these components are attached to the removable U-shaped bottom plate 2 of compartment 21. This arrangement greatly simplifies assembly of the aforementioned components onto the wheelchair structure. The shape and dimensions of the specially configured compartment 21 and associated bottom plate 2 provide the capability for the wheelchair to be positioned over a toilet and over at least one of the reconfigurable bed sections. Furthermore, the volume of the space below the wheelchair's seat section 9 must be totally clear of any obstructing objects.

In the preferred embodiment of the wheelchair, the front wheels are confined to rotate about their axle 23.1, as directed by their associated motors 23, whereas the back wheels are not motorized and are free to pivot in the direction of a turn. Wheelchair turning is accomplished by selective rotational action of the front wheel motors 23, as is well known in the art.

There are two sets of wheelchair components that require assistance from a caregiver, namely, the latching mechanisms 6 (FIGS. 3, 7 and 10) which extend through the back section rod access openings 8 (FIG. 4A) to secure the back section rods 5 to the wheelchair upper frame portion 1.1 via the attachment holes 7 provided in the upper frame portion (see FIG. 5B); and the footrest 18 which is secured to each side of the wheelchair lower frame portion 1.3 by locking mechanisms 19, as shown in FIGS. 1A and 2. The latching and locking mechanisms may be hand-twisted screws or any other suitable fastening means. These components are required for patient safety and comfort in addition to ensuring proper rotational positioning of the coupler access openings 27 located on the back section and leg section transverse rods 40, 41. However, it is possible to replace the manual latching mechanisms for the back section with electrical latching mechanisms to eliminate the need for caregiver assistance. Likewise, it is possible to replace the manual footrest locking mechanisms with electrical footrest locking mechanisms which could automatically displace the footrest out of the way when required, e.g., when raising the leg section. Replacement of the manual footrest locking mechanisms with electrical footrest locking mechanisms that could automatically displace the footrest out of the way would eliminate the need for caregiver assistance.

Figure 13:
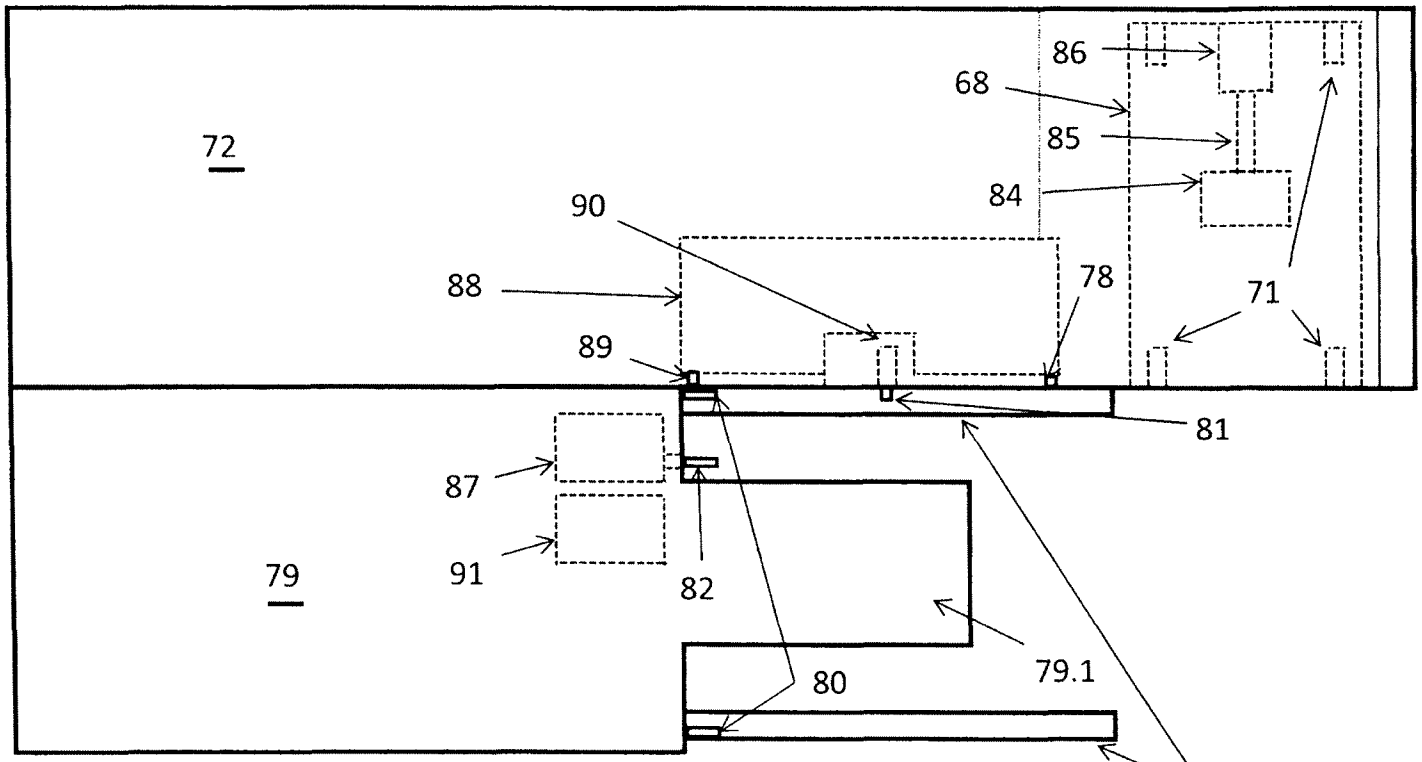
FIG. 13 is a top view of the segmented bed of the present invention showing the main bed section bottom frame, the upper/middle reconfigurable bed section bottom frame (without mattresses), the wheelchair alignment tracks, the securing/aligning pins, the deployed deadbolt, the power management module connector, and, in phantom, the segmented bed power and mechanical mechanisms at their relative placement locations within the bottom bed frames of the main and upper-middle bed sections.

A number of openings on the frame of the wheelchair allow access to important auxiliary functions. On the lower frame portion 1.3 of the wheelchair, openings 30 allow access to the securing and aligning pins 80, and opening 26 allows access to the power management module connector 82 (see FIG. 7). The pins 80 and the connector 82 are firmly mounted on the bottom frame 79 of the upper-middle reconfigurable bed sections 73, 74. The pins reinforce the wheelchair alignment to the main bed section 46 that is initially provided by the alignment tracks 60 (see FIGS. 13, 20 and 23-25). The pins 80 prevent the wheelchair from damaging the relatively fragile power management module connector 82. The power management module connector 82 provides the electrical connection between the system command controller 25 located in one of the armrests 17 of the wheelchair and the power management module 87 housed in the bottom frame 79, 79.1 of the upper and middle reconfigurable bed sections 73, 74 (see FIG. 13). Additionally, the connector 82 establishes electrical continuity between the wheelchair batteries 22 and the battery charger 91 as dictated by the power module 87 under the commands of the system command controller 25. The battery charger 91 is housed within the bottom frame 79 of the upper reconfigurable bed section, as shown in FIG. 13.

The lower frame portion 1.3 of the wheelchair (FIGS. 1A, 1B, 3 and 10) is further provided with an additional opening 28 to allow access to the wheelchair securing-and-positioning deadbolt 81. The deadbolt 81 is firmly mounted on the bed frame 72 of the main bed section 46. When deployed, the alignment provided by the deadbolt 81 ensures proper coupling between the motorized rotational couplers 89, 78 on the side of the main bed section 46 and the rotational coupler access openings 27 on the lower transverse rods of the back section 4 and leg section 12, respectively. In addition, the deployed deadbolt 81 forces the wheelchair to remain stationary over the alignment tracks 60 whenever required. The deadbolt 81 is retracted by a system command whenever wheelchair motion over the alignment tracks 60 is desired.

The segmented bed 300 comprises a main bed section 46 and three smaller reconfigurable bed sections 73, 74, 75 (see FIG. 1A). The main bed section 46 is intended for caregiver accommodation and houses, either under, inside, or outside its frame 72, a number of components. Each reconfigurable bed section comprises at least a bottom frame, a lifting mechanism, a top frame and a mattress. The top frames and mattresses of the reconfigurable bed sections are sized to fit within the area encompassed by the rods of the back section 4, the seat section 9, and the leg section 12 which, as previously explained, define the wheelchair patient support area. In other words, the top frames and mattresses of the reconfigurable bed sections fit within the boundaries of the back section 4, the seat section 9 and the leg section 12. The reconfigurable bed sections associated with the back section 4 and the seat section 9 share a common bottom frame 79, 79.1 which frame also houses a number of components. In several of the figures depicting the reconfigurable bed sections 73, 74, 75, the floor surface 63 is shown for reference purposes.

Figure 26:
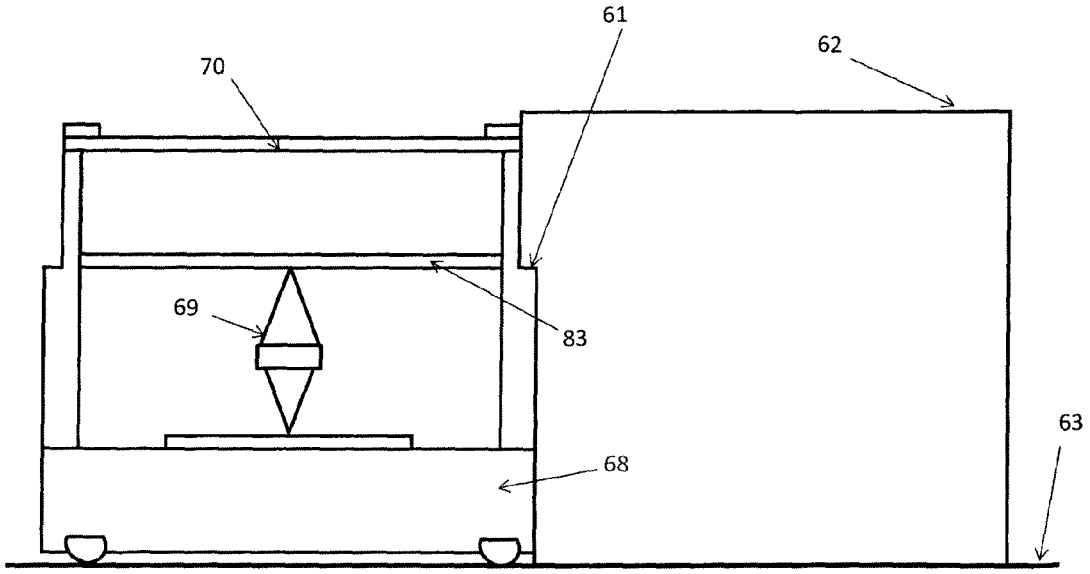
FIG. 26 is a front view of the impaired person care system of the present invention showing the reconfigurable powered wheelchair in the horizontal lying-down resting position and disconnected from the rotational couplers of the main bed section, with the lower reconfigurable bed section positioned at its high height setting.

The main bed section 46 of the segment bed 300 comprises a bed frame 72, a mattress 64, a headboard 67, and a footboard 62 (see FIG. 1A). The bed frame 72 houses a power module housing 88, a linear actuator 86 and a wheel chair securing deadbolt housing 90, as shown in FIG. 13. The power module housing 88 contains two motors 92 with their associated gears 94 and belts 93, which independently drive the retractable couplers 89, 78 responsible for the rotation of the wheelchair back section 4 and leg section 12 (see FIGS. 14A and 14B). The linear actuator 86 is responsible for deployment and retraction of the lower reconfigurable bed section 75. The wheelchair securing deadbolt 81 ensures proper positioning of the wheelchair relative to the rotational couplers 78, 89, as previously stated. The bed frame 72 also features a contour 61 which prevents the wheelchair from tilting sideways while the wheelchair is configured in the lying-down resting position (see FIG. 26).

Figures 14A, 14B:
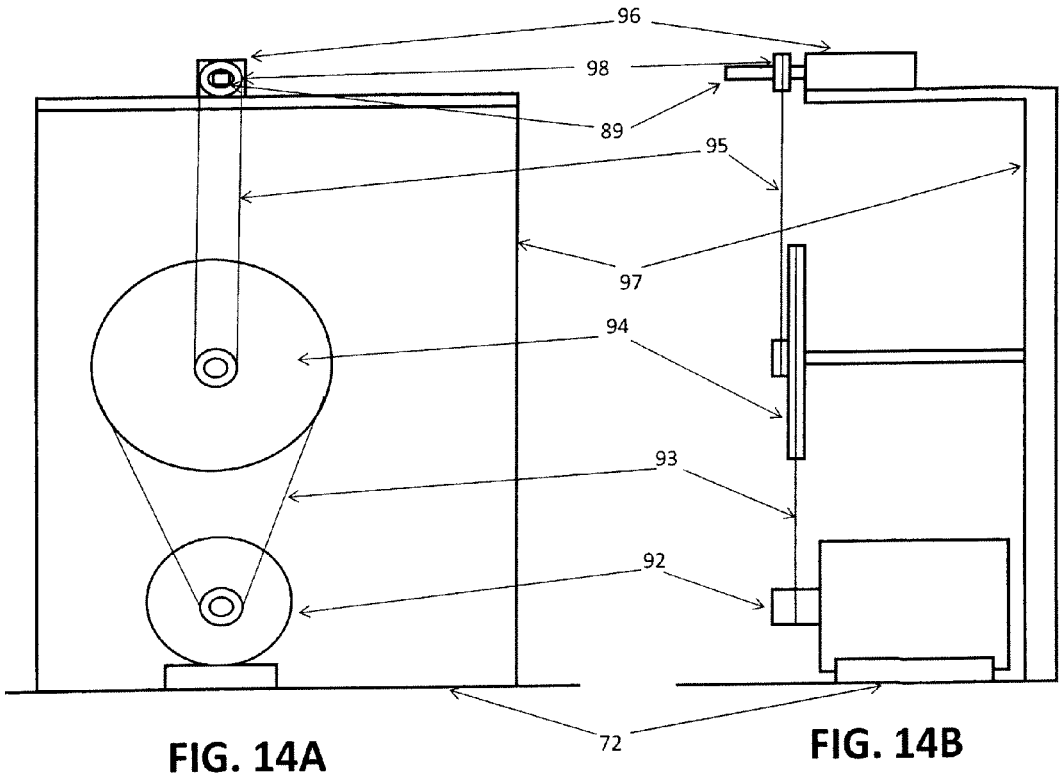
FIG. 14A is a front view of the preferred embodiment of the mechanisms (motors, gears and belts) responsible for rotating the leg section and/or the back section of the wheelchair of the present invention into their upright and horizontal positions, with the interface between the rotational-coupler gear and the electromagnetic plunger-style rotational coupler greatly simplified for the sake of clarity.
FIG. 14B is a side view of the preferred embodiment of the mechanism (motors, gears and belts) responsible for rotating the leg section and/or back section of the wheelchair of the present invention into their upright and horizontal positions, with the interface between the rotational-coupler gear and the electromagnetic plunger-style rotational coupler greatly simplified for the sake of clarity.

The retractable coupler mechanisms can be better understood by referring to FIGS. 14A and 14B. These figures show the mechanisms associated with the rotational couplers for the back section 4. However, the mechanisms associated with the rotational couplers for the leg section 12 are identical. It should be emphasized, however, that the back section rotational coupler 89 and leg section rotational coupler 78 must operate independently. This is necessary for deployment of the lower reconfigurable bed 75 prior to any of the bed raising options, as discussed in detail below. The preferred embodiment of the invention uses two independent sets of motors, gears and belts to establish this independence. However, other suitable configurations may be used to accomplish the described functions.

FIGS. 14A and 14B show front and side views of power motor 92, motor to ratio-gear belt 93, ratio gear 94, ratio-gear to coupler-gear belt 95, coupler gear 98, electromagnetic plunger-like coupler 89, coupler housing 96 and support structure 97 for the components. The motor 92 and support structure 97 are firmly secured to the bottom of main bed frame 72. The functionality of the components shown in FIGS. 14A and 14B is well understood in the art and no further explanation is deemed necessary.

Figures 15A, 15B:
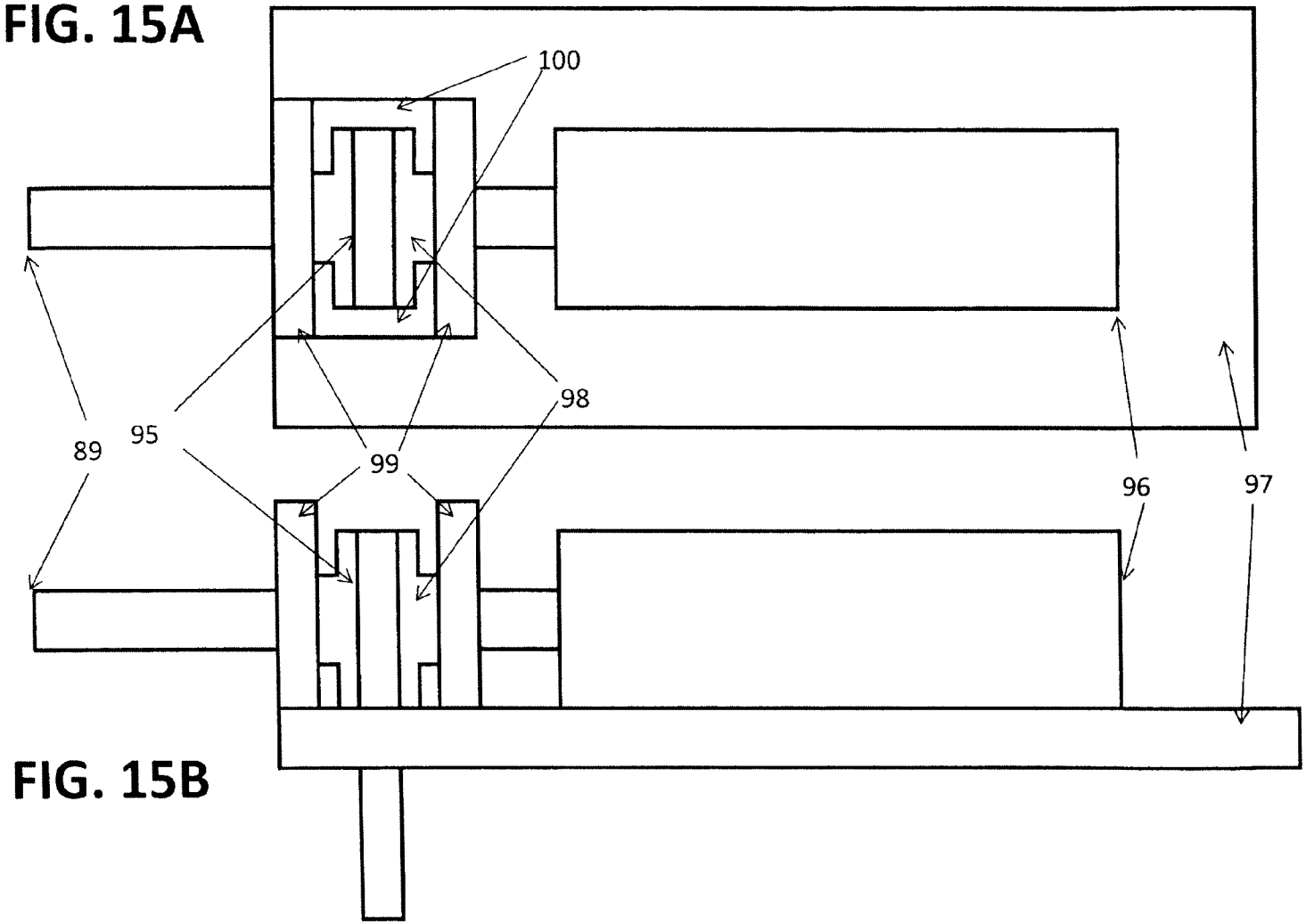
FIG. 15A is a top view of the preferred embodiment of the interface arrangement between the rotational-coupler gear and the electromagnetic plunger-style rotational coupler that provides the structural integrity which the simplified version shown in FIG. 13A does not show.
FIG. 15B is a side view of the preferred embodiment of the interface arrangement between the rotational-coupler gear and the electromagnetic plunger-style rotational coupler that provides the structural integrity which the simplified version shown in FIG. 13A does not show.
Figure 16:
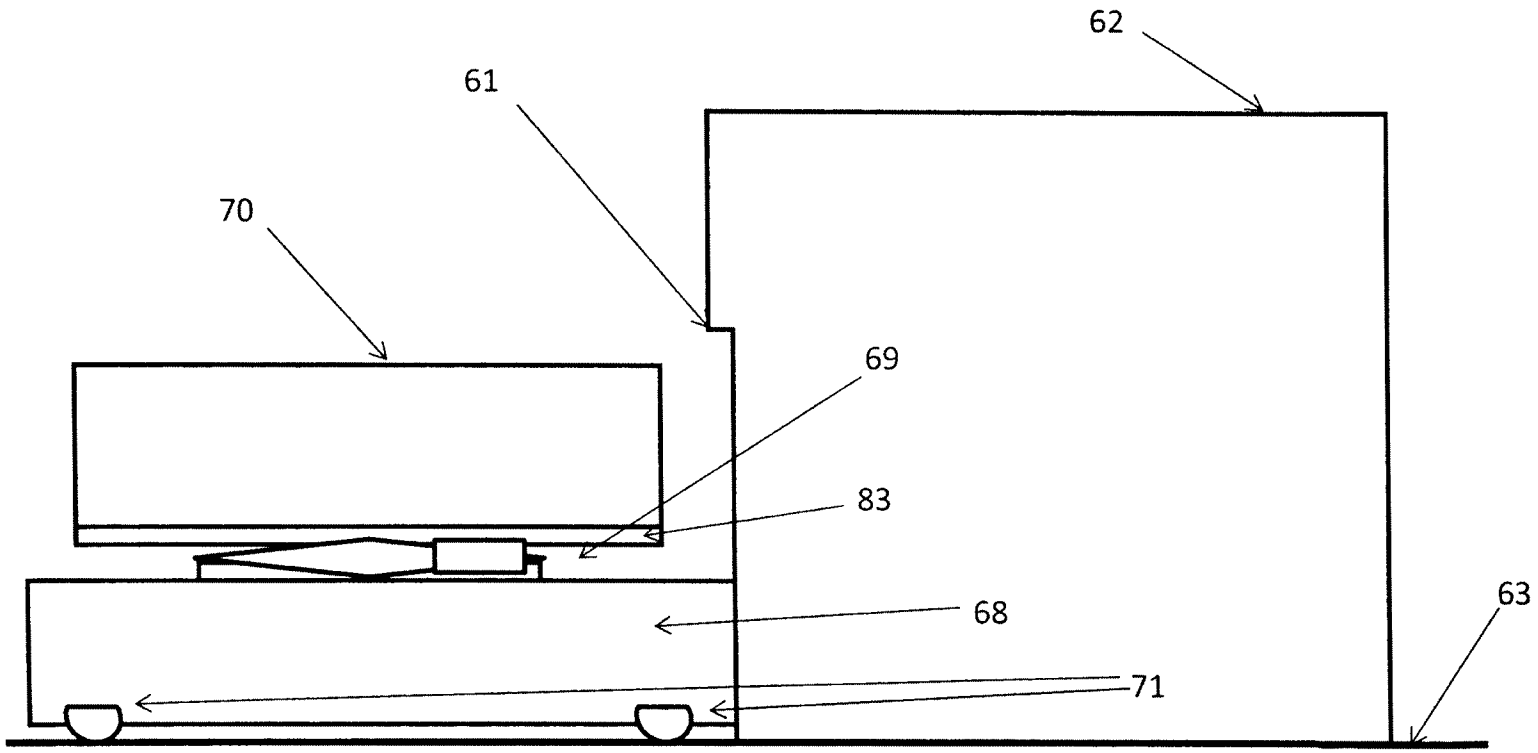
FIG. 16 is a front view of the segmented bed of the present invention showing the lower reconfigurable bed section positioned at its low height setting after deployment.

FIGS. 15A and 15B show top and side views of ratio-gear to coupler-gear belt 95, coupler gear 98, electromagnetic plunger-like coupler 89 and coupler housing 96. The figures also depict the interrelationship among the components. Coupler gear 98 is configured to fit into two symmetric vertical structural supports 99 derived from the horizontal structural support 97. Belt 95 and middle section of the gear 98 operate above an opening 100 in the supporting structure.

It should be apparent that the arrangement described immediately above allows for rotation of the gear 98, as demanded by its associated belt, while providing the robustness that the arrangement shown in FIGS. 4A and 14B lacks. It also should be understood that the transverse cross-sections of the plunger-like coupler and its associated gear opening are both square. As such, they are able to implement the rotation function required by back section 4 and leg section 12 of the powered wheelchair.

Figure 20:
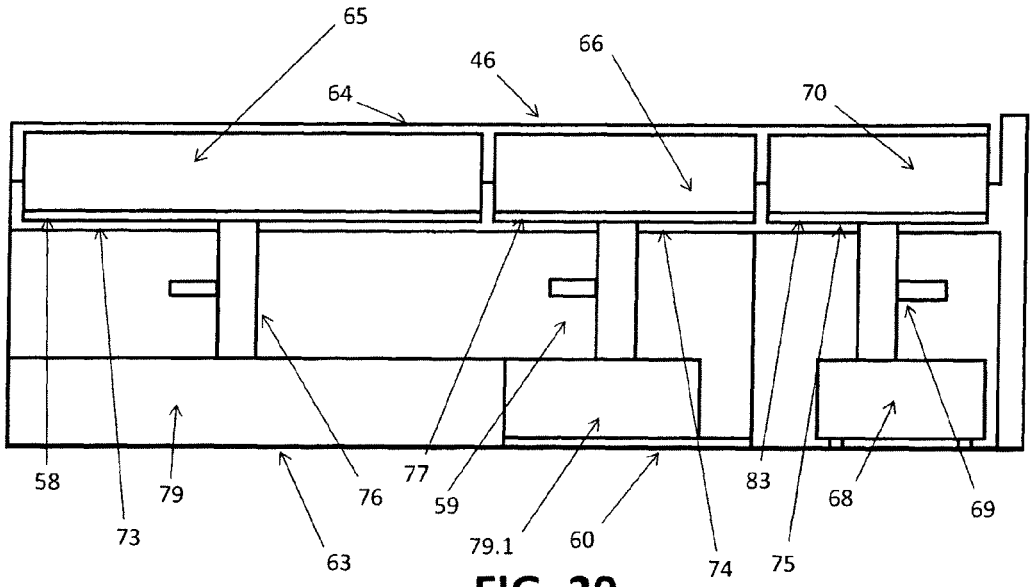
FIG. 20 is a side view of the segmented bed of the present invention showing the upper, middle and lower reconfigurable bed sections positioned at their high height settings.
Figure 21:
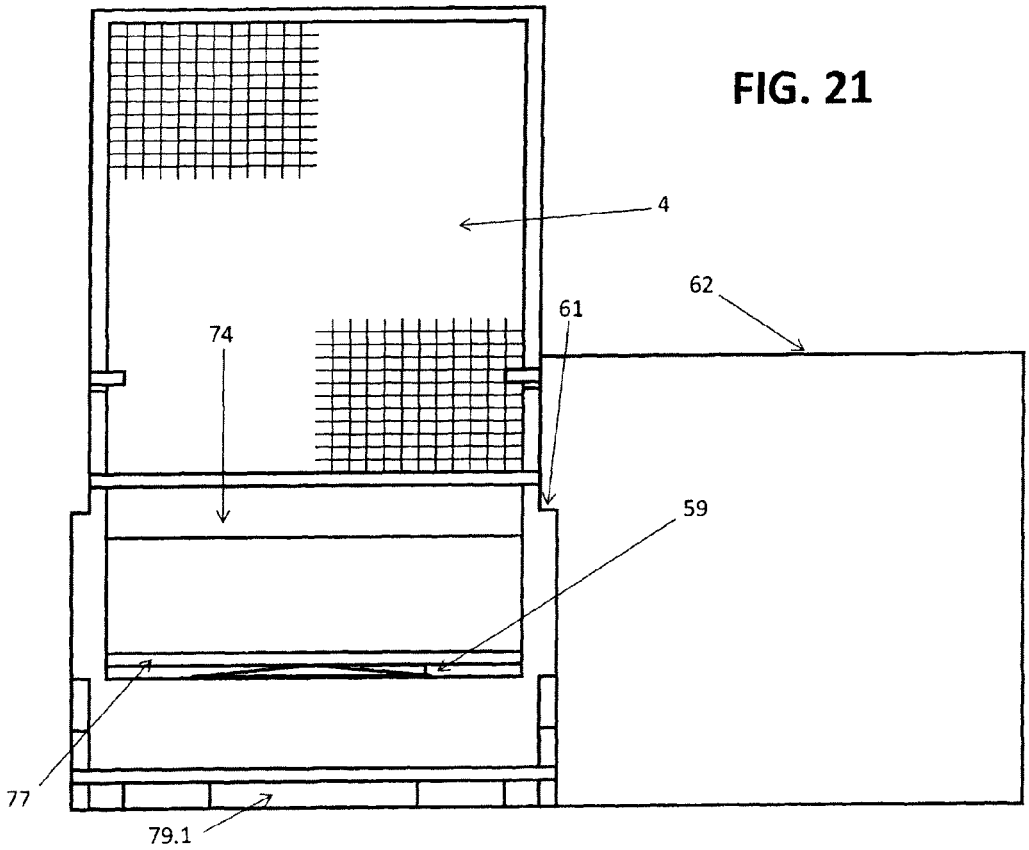
FIG. 21 is a front view of the impaired person care system of the present invention showing the reconfigurable powered wheelchair in the partially horizontal sitting position and connected to the leg section rotational coupler of the main bed section, with the middle reconfigurable bed section positioned at its low height setting prior to deployment of the lower reconfigurable bed section.
Figure 22:
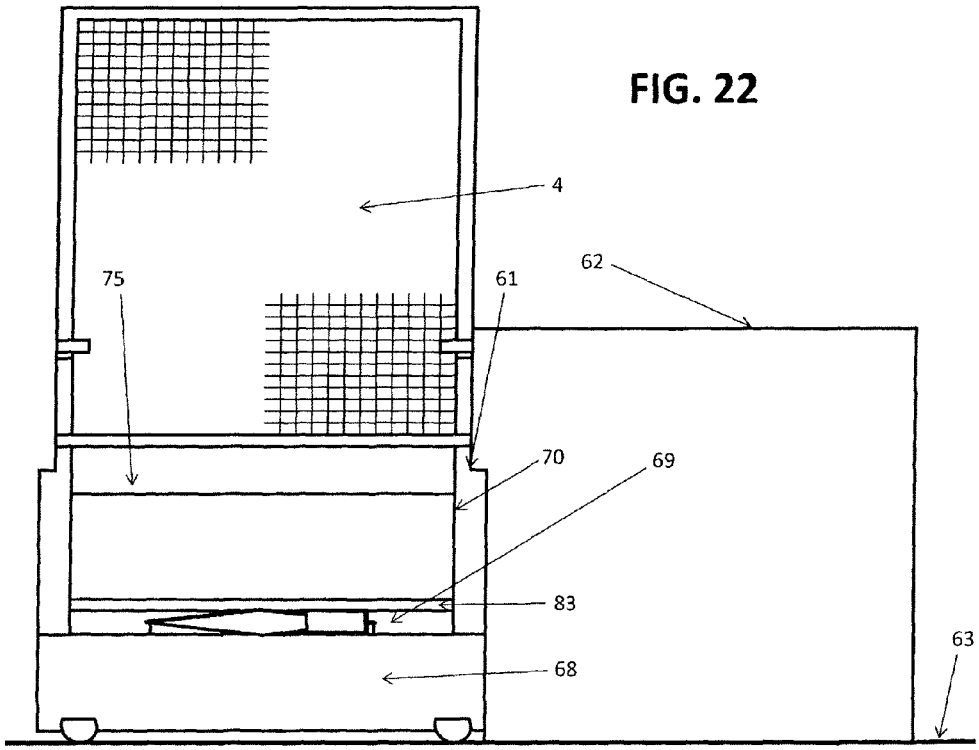
FIG. 22 is a front view of the impaired person care system of the present invention showing the reconfigurable powered wheelchair in the partially horizontal sitting position and connected to the leg section rotational coupler of the main bed section, with the lower reconfigurable bed section positioned at its low height setting after deployment of the lower bed section.

The upper reconfigurable bed section 73, as shown in FIG. 20, includes a bottom frame 79, a top frame 58, a mattress 65 and a motorized lifting mechanism 76, such as a standard automobile lifting jack. However, it should be understood that any other suitable lifting mechanism may be used to raise and lower the reconfigurable bed section. The bottom frame 79 is physically attached to the main bed section 46. The bottom frame 79 of bed section 73 further includes a power management module 87 with its associated wheel chair connector 82, a battery charger 91 and two wheelchair securing and aligning pins 80, as shown in FIG. 13. The function of the latter set of components has been described above.

The middle reconfigurable bed section 74, as shown in FIG. 20, includes a bottom frame 79.1 that is a narrow extension of the bottom frame 79 of the upper reconfigurable bed section. The middle reconfigurable bed section 74 further includes a top frame 77, a mattress 66, a motorized lifting mechanism 59 similar to lifting mechanism 76, and two wheelchair alignment tracks 60. The overall width, height and depth of the bottom frame 79.1, collapsed lifting mechanism 59, top frame 77 and associated mattress 66 must fit within the clear volume of space under the seat section 9 of the powered wheelchair 200. Alternatively, the alignment tracks 60 may be eliminated and the edges of the middle reconfigurable bed section bottom frame extension 79.1 used for alignment purposes. Furthermore, wheelchair alignment may also be implemented by using suitable grooves carved into two flat panels lying on the floor 63 and firmly attached to one or both of the bottom frames 79, 79.1 of the upper and middle reconfigurable bed sections 73, 74 (not shown in the figures).

Figure 23:
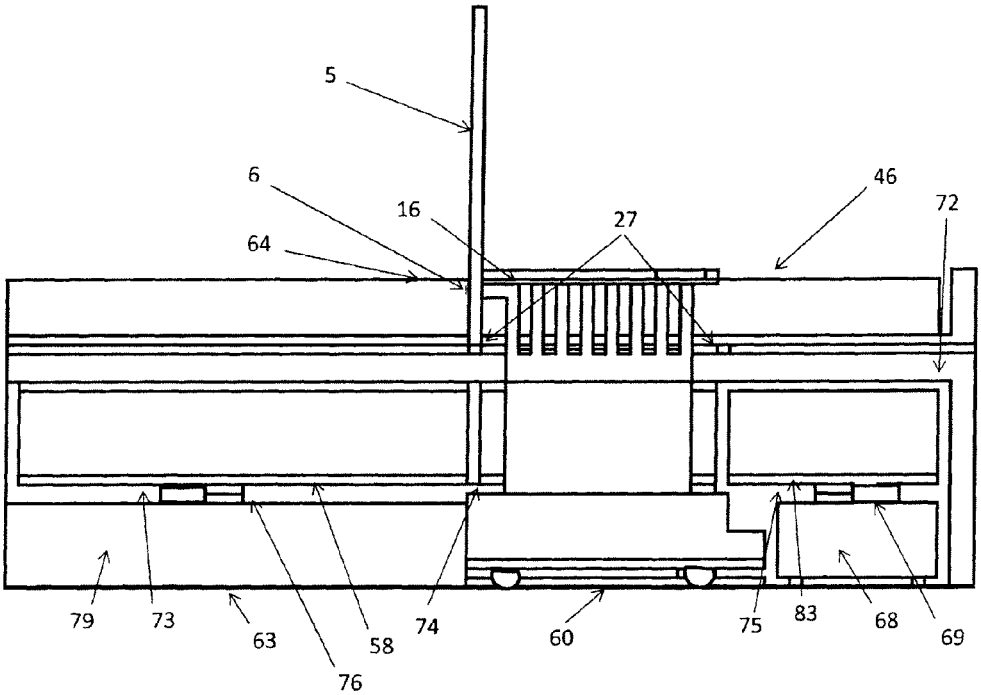
FIG. 23 is a side view of the impaired person care system of the present invention showing the reconfigurable powered wheelchair in the partially horizontal sitting position and connected to the leg section rotational couplers of the main bed section, with the reconfigurable bed sections positioned at their low height settings.
Figure 24:
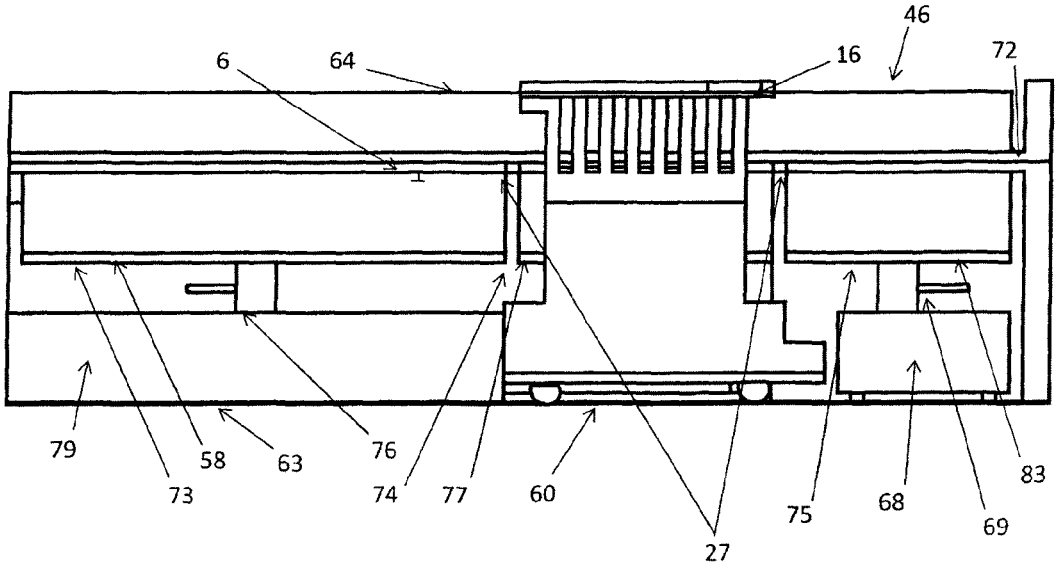
FIG. 24 is a side view of the impaired person care system of the present invention showing the reconfigurable powered wheelchair in the horizontal lying-down resting position and connected to the rotational couplers of the main bed section, with the reconfigurable bed sections positioned at their intermediate height settings.

The lower reconfigurable bed section 75, as shown in FIG. 20, includes a bottom frame 68, a top frame 83, a mattress 70, a motorized lifting mechanism 69 similar to lifting mechanism 76, and four wheels 71. The lower reconfigurable bed section 75 is further associated with the main bed section 46 in a drawer-like arrangement. In this regard, the lower reconfigurable bed section 75 is hidden under the main bed frame 72 to allow wheelchair access to the bed structure. A linear actuator 86, for example a motor or hydraulically driven piston, (see FIG. 13) extends the lower bed section 75 under the leg section 12 of the wheelchair and retracts the lower bed section 75 from under the leg section 12 of the wheelchair when the wheelchair is being readied for lifting/releasing tasks. The actuator stroke 85 is securely coupled by a coupling mechanism 84 to the bottom frame 68 of the lower reconfigurable bed section 75. Prior to deployment of the lower reconfigurable bed section, the leg section motorized coupler 78 is deployed and rotated to place the wheelchair leg section 12 in a horizontal position, as previously discussed and as shown in FIG. 23.

Figure 25:
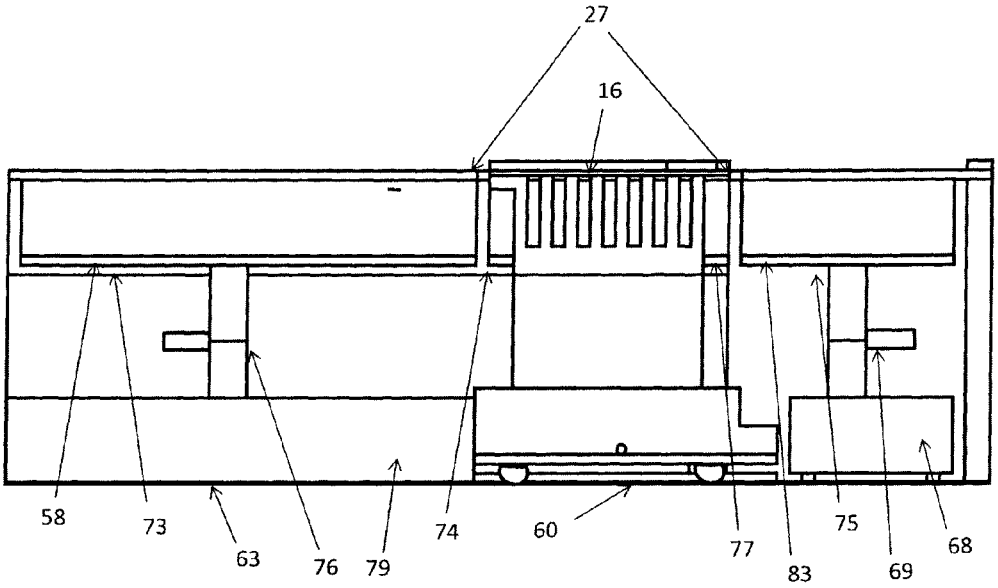
FIG. 25 is a side view of the impaired person care system of the present invention showing the reconfigurable powered wheelchair in the horizontal lying-down resting position and disconnected from the rotational couplers of the main bed section, with the reconfigurable bed sections positioned at their high height settings.

The lower, middle and upper reconfigurable bed sections can be set at three height settings: low, intermediate and high. The low height setting allows free movement of the wheelchair next to the main bed section 46 before deployment or after retraction of the lower reconfigurable bed section 75. The intermediate height setting allows for the impaired individual to be placed in a comfortable position resting over all three mattresses prior to all the beds being raised to the high height setting, without the need for patient support area locking mechanisms. The high height setting lifts the patient and wheelchair to a height which is substantially commensurate or coplanar with the main bed section mattress 64 so that the patient is in a comfortable lying-down bed resting position, adjacent a caregiver, as shown in FIGS. 1E and 25.

Figure 12:
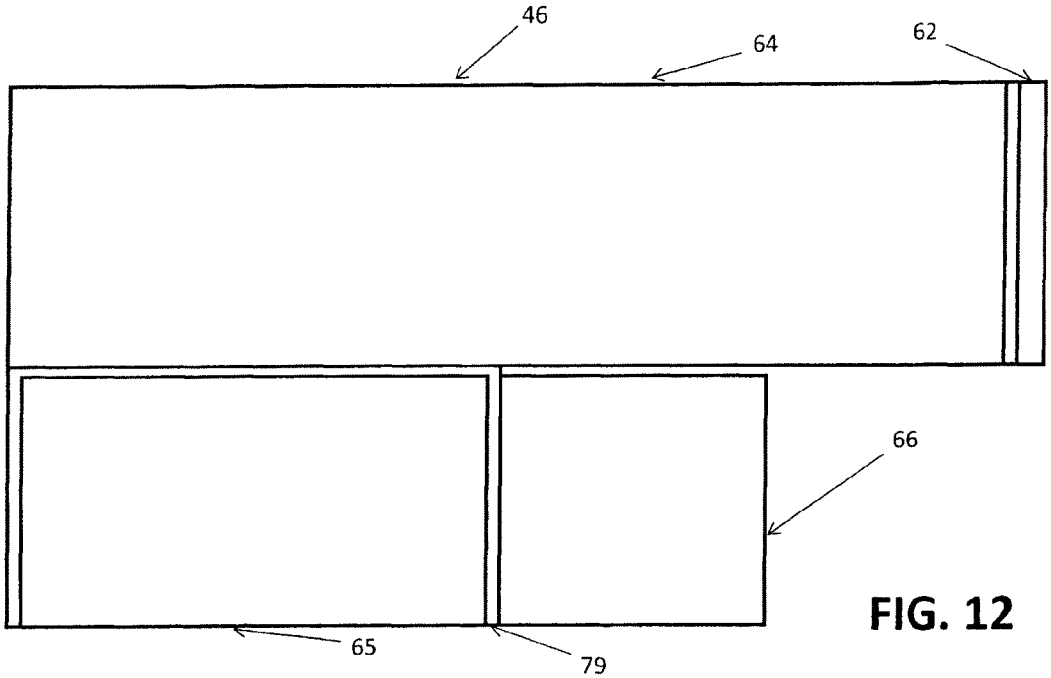
FIG. 12 is a top view of the segmented bed of the present invention showing the upper and middle reconfigurable bed section prior to deployment the lower reconfigurable bed section.
Figure 18:
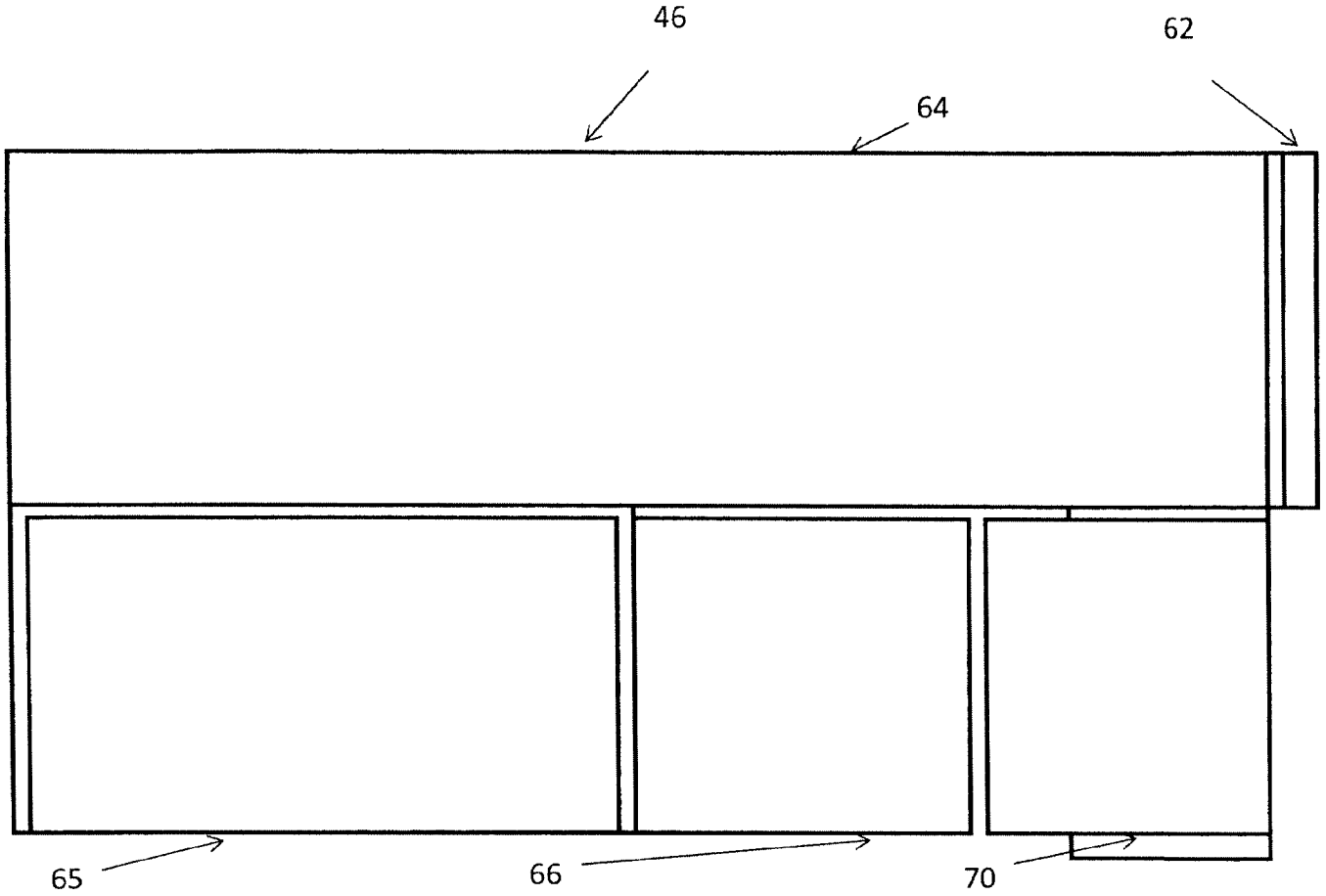
FIG. 18 is a top view of the segmented bed of the present invention showing the upper, middle and lower reconfigurable bed sections positioned at either their low, intermediate or high height settings after deployment of the lower reconfigurable bed section.
Figure 19:
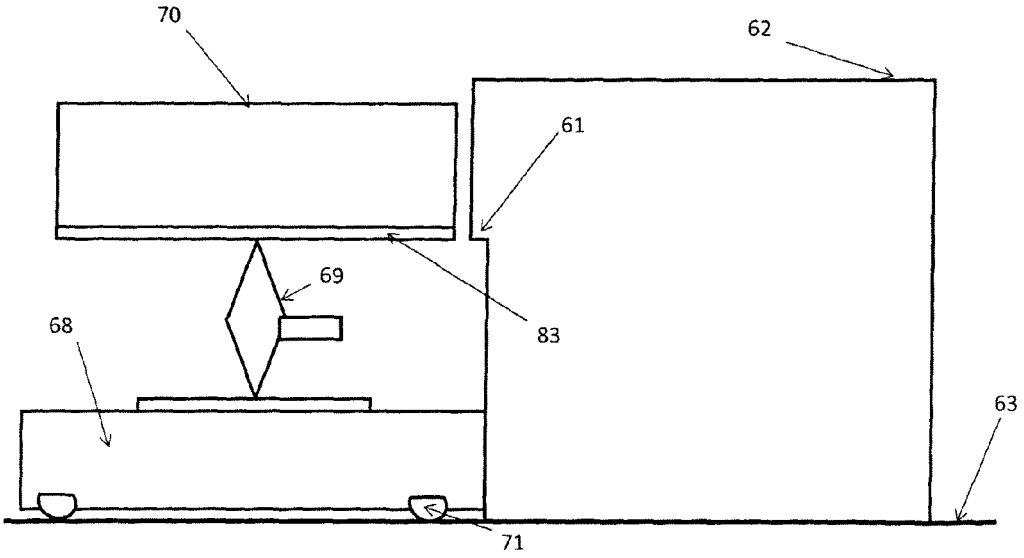
FIG. 19 is a front view of the segmented bed of the present invention showing the lower reconfigurable bed section positioned at its high height setting after deployment of the lower bed segment.

It should be apparent from the above description of the present invention that the combination of upper, middle and lower reconfigurable bed mattresses, together with the cushioned fabric material of the corresponding back, seat and leg sections in the patient support area of the wheelchair, creates a very comfortable setting for patients to rest. Because of the relative dimensions chosen for the components of the upper, middle and lower reconfigurable bed sections and the unavoidable pull of gravity, the rods of the back section, seat section and leg section will "fall" out of the way through spaces created around the sides of the mattresses of the reconfigurable bed sections and below the top surfaces of the mattresses (see FIGS. 12 and 18). The wheelchair armrests will remain above the top surface of the mattress of the middle bed section, as shown in FIG. 1E, and may be used by the impaired individual as a hand grip for assisting sliding or turning while in a lying-down bed resting position.

Operation of the Impaired Person Care System

Whenever the impaired individual is in need of a bowel movement, the powered or motorized wheelchair is placed in its upright sitting configuration and maneuvered to a position wherein the toilet access aperture 11 is directly over the toilet or commode, as shown in FIG. 2. Since the wheelchair has a toilet access aperture or opening 11 in its seating area, an unobstructed bowel movement can take place.

When the patient desires to return to a lying-down bed resting position, the wheelchair is maneuvered to line up with the alignment tracks 60 or the aligning edges of the bottom frame 79.1 of the middle reconfigurable bed section 74. The wheelchair is then positioned directly over the middle reconfigurable bed section, as shown in FIG. 1B. In this position, the engaged power management module connector 82 enables electrical connection between the system command controller 25 on the wheelchair armrest 17 and the power management module 87 inside the reconfigurable bed section 73.

A command to deploy the deadbolt 81 from the main bed section 46 is then issued, followed by a command to extended and mate the rotational couplers 78, 89 with the coupler access openings 27 in the back and leg sections 4, 12 of the wheelchair, as depicted in FIG. 1B. Since the back section 4, seat section 9, and leg section 12 of the wheelchair are now immobilized by the protruding couplers, the caregiver can proceed to remove the footrest 18 and loosen the latching mechanisms 6 securing the back section to the wheelchair frame.

Thereafter, the coupler 78 associated with the wheelchair leg section 12 is activated and the leg section is brought to its partially unfolded position, as shown in FIG. 1C. Once free space is created under the leg section, the lower reconfigurable bed section 75 is brought out from under the main bed section 46 and positioned directly under the leg section, as also shown in FIG. 1C. At this point, the reconfigurable bed sections 73, 74, 75 are brought up to their intermediate height setting, and the coupler 89 associated with the wheelchair back section 4 is activated to set the wheelchair in its fully unfolded position, as shown on FIG. 1D.

After the wheelchair is fully unfolded into a substantially flat, coplanar position, both couplers 78, 89 are retracted into the main bed section 46 and all the reconfigurable bed sections 73, 74, 75 are brought up to their high height setting, as depicted in FIG. 1E. In this setting, the patient rests comfortably at a height substantially coplanar with the mattress of the main bed section 46, and the patient support area, defined by the back section 4, seat section 9 and leg section 12, lies directly on and is vertically supported by the corresponding mattresses 65, 66, 70 of reconfigurable bed sections 73, 74, 75. Gaps created between and around the reconfigurable bed section mattresses (see FIGS. 12, 18) allow for the patient support area rods 5, 10, 13 to adjust to a level below the surfaces of mattress 65, 66, 70, as shown in FIG. 1E.

The steps described above for the interaction between the reconfigurable powered wheelchair and the segmented bed with reconfigurable bed sections may be reversed whenever the patient experiences the urge for another bowel movement.

The powered wheelchair batteries 22 may be charged at the patient's or caregiver's command any time the wheelchair is "docked" to the upper reconfigurable bed section 73.

The invention claimed is:

1. An impaired person care system comprising:

a bed having a main bed section and a set of reconfigurable bed sections adjacent the main bed section, wherein the main bed section includes a mattress and the set of reconfigurable bed sections comprises a middle reconfigurable bed section having a mattress, a bottom frame, and a lifting mechanism between the mattress and the bottom frame for raising the mattress from a low height setting in which the mattress is below the main bed section mattress to a high height setting in which the mattress is substantially commensurate in height with the main bed section mattress; and a powered wheelchair reconfigurable from an upright sitting position to a horizontal lying-down resting position, the wheelchair including a frame structure, wheelchair locomotion components including wheels, and a patient support area comprising at least a seat section with a toilet access aperture defined therethrough; the locomotion components and the seat section being supported by the frame structure;

wherein the frame structure is configured to provide a space of predetermined width and height beneath the seat section and between the wheels that is free from structural obstacles;

wherein the mattress, lifting mechanism and bottom frame of the middle reconfigurable bed section are configured to fit within said free space;

wherein, in the upright sitting position of the wheelchair, the seat section of the wheelchair is positionable over a standard toilet when said free space is disposed around the toilet, and wherein, in the upright sitting position of the wheelchair, the seat section is positionable over the mattress, lifting mechanism, and bottom frame of the middle reconfigurable bed section when the middle reconfigurable bed section is in its low height setting and disposed within said free space so that the mattress of the middle reconfigurable bed section may be raised into engagement with the seat section upon activation of the lifting mechanism.

2. An impaired person care system comprising:

a segmented bed having a main bed section and at least one reconfigurable bed section adjacent the main bed section, each bed section including a mattress; the at least one reconfigurable bed section having a lifting mechanism for raising the reconfigurable bed section mattress from a low height setting in which the mattress is below the main bed section mattress to a high height setting in which the reconfigurable bed section mattress is substantially commensurate in height with the main bed section mattress; and a reconfigurable powered wheelchair including a frame structure, wheelchair locomotion components, and a patient support area comprising at least a seat section with a toilet access aperture defined therethrough; the locomotion components and the seat section being supported by the frame structure;

wherein the at least one reconfigurable bed section comprises upper, middle, and lower reconfigurable bed sections, each of the upper, middle, and lower reconfigurable bed sections being smaller than the main bed section and including a bottom frame, a mattress, and a lifting mechanism between the bottom frame and the mattress for raising the mattress from its low height setting to its high height setting;

wherein the frame structure is configured to provide a space of predetermined width and height beneath the seat section that is free from structural obstacles;

wherein the seat section of the wheelchair is positionable over a standard toilet when the free space is disposed around the toilet, and the seat section of the wheelchair is positionable over the mattress of the middle reconfigurable bed section when the middle reconfigurable bed section is in its low height setting and disposed within the free space; and wherein the lower reconfigurable bed section is additionally movable from an extended position adjacent the middle reconfigurable bed section to a retracted position under the main bed section and vice versa when in its low height setting; and the seat section of the wheelchair is positionable over the mattress of the middle reconfigurable bed section when the middle reconfigurable bed section is in its low height setting and the lower reconfigurable bed section is in its retracted position under the main bed section.

3. An impaired person care system comprising:

a segmented bed having a main bed section and at least one reconfigurable bed section adjacent the main bed section, each bed section including a mattress; the at least one reconfigurable bed section having a lifting mechanism for raising the reconfigurable bed section mattress from a low height setting in which the mattress is below the main bed section mattress to a high height setting in which the reconfigurable bed section mattress is substantially commensurate in height with the main bed section mattress; and a reconfigurable powered wheelchair including a frame structure, wheelchair locomotion components, and a patient support area comprising at least a seat section with a toilet access aperture defined therethrough; the locomotion components and the seat section being supported by the frame structure;

wherein the at least one reconfigurable bed section comprises upper, middle, and lower reconfigurable bed sections, each of the upper, middle, and lower reconfigurable bed sections being smaller than the main bed section and including a bottom frame, a mattress, and a lifting mechanism between the bottom frame and the mattress for raising the mattress from its low height setting to its high height setting;

wherein the frame structure is configured to provide a space of predetermined width and height beneath the seat section that is free from structural obstacles;

wherein the seat section of the wheelchair is positionable over a standard toilet when the free space is disposed around the toilet, and the seat section of the wheelchair is positionable over the mattress of the middle reconfigurable bed section when the middle reconfigurable bed section is in its low height setting and disposed within the free space; and wherein the bottom frame of the middle reconfigurable bed section is a narrow extension of the bottom frame of the upper reconfigurable bed section, and edges of the narrow extension function as alignment structure to align the wheelchair over the middle reconfigurable bed section and align the wheelchair with the main bed section.

4. An impaired person care system comprising:

a segmented bed having a main bed section and at least one reconfigurable bed section adjacent the main bed section, each bed section including a mattress; the at least one reconfigurable bed section having a lifting mechanism for raising the reconfigurable bed section mattress from a low height setting in which the mattress is below the main bed section mattress to a high height setting in which the reconfigurable bed section mattress is substantially commensurate in height with the main bed section mattress; and a reconfigurable powered wheelchair including a frame structure, wheelchair locomotion components, and a patient support area comprising at least a seat section with a toilet access aperture defined therethrough; the locomotion components and the seat section being supported by the frame structure;

wherein the at least one reconfigurable bed section comprises upper, middle, and lower reconfigurable bed sections, each of the upper, middle, and lower reconfigurable bed sections being smaller than the main bed section and including a bottom frame, a mattress, and a lifting mechanism between the bottom frame and the mattress for raising the mattress from its low height setting to its high height setting;

wherein the frame structure is configured to provide a space of predetermined width and height beneath the seat section that is free from structural obstacles;

wherein the seat section of the wheelchair is positionable over a standard toilet when the free space is disposed around the toilet, and the seat section of the wheelchair is positionable over the mattress of the middle reconfigurable bed section when the middle reconfigurable bed section is in its low height setting and disposed within the free space; and wherein the bottom frame of the middle reconfigurable bed section includes two alignment tracks that function to align the wheelchair over the middle reconfigurable bed section and align the wheelchair with the main bed section.

5. The impaired person care system of claim 1, wherein the seat section includes support rods and the patient support area further comprises a back section having a rod frame rotatably coupled to an end of the seat section support rods, and a leg section having a rod frame rotatably coupled to an opposite end of the seat section support rods; the back section rod frame and the leg section rod frame each having rotational access openings engageable by rotational couplers located in the main bed section to reconfigure the back section and the leg section from the upright sitting position to the horizontal lying-down resting position and vice versa.

6. The impaired person care system of claim 5, wherein the rotational couplers are extendable and retractable into and out of engagement with the access openings when the seat section of the wheelchair is positioned over the middle reconfigurable bed section.

7. The impaired person care system of claim 5, wherein the patient support area includes soft, cushioned material extending between an area encompassed by rods of the back section rod frame, rods of the seat section, and rods of the leg section rod frame; the soft, cushioned material defining sitting and lying-down resting areas in contact with a patient.

8. An impaired person care system comprising:

a segmented bed having a main bed section and at least one reconfigurable bed section adjacent the main bed section, each bed section including a mattress; the at least one reconfigurable bed section having a lifting mechanism for raising the reconfigurable bed section mattress from a low height setting in which the mattress is below the main bed section mattress to a high height setting in which the reconfigurable bed section mattress is substantially commensurate in height with the main bed section mattress; and a reconfigurable powered wheelchair including a frame structure, wheelchair locomotion components, and a patient support area comprising at least a seat section with a toilet access aperture defined therethrough; the locomotion components and the seat section being supported by the frame structure;

wherein the frame structure is configured to provide a space of predetermined width and height beneath the seat section that is free from structural obstacles;

wherein the seat section of the wheelchair is positionable over a standard toilet when the free space is disposed around the toilet, and the seat section of the wheelchair is positionable over the mattress of the at least one reconfigurable bed section when the reconfigurable bed section is in its low height setting and disposed within the free space; and wherein the wheelchair frame structure comprises upper frame portions, middle frame portions, and lower frame portions, the upper frame portions being on opposite sides of the seat section and being provided with elongated slots; the seat section further includes interface flanges attached to the support rods, the interface flanges having comb-like teeth extending through the slots to provide additional support for the seat section and provide guidance for upward and downward seat section movement within the boundaries of the slots.

9. The impaired person care system of claim 8, wherein the slots in the upper frame portions of the wheelchair are capped by a seat assembly cap and an armrest.

10. The impaired person care system of claim 9, wherein a system command controller is housed in one of the armrests.

11. The impaired person care system of claim 8, wherein a removable footrest is attached to the lower frame portions.

12. The impaired person care system of claim 7, wherein the set of reconfigurable bed sections further comprises upper and lower reconfigurable bed sections, each having a bottom frame, a mattress and a lifting mechanism between the bottom frame and its associated mattress for raising its associated mattress from a low height setting in which the mattress is below the main bed section mattress to a high height setting in which the mattress is substantially commensurate in height with the main bed section, and wherein each of the upper, middle, and lower reconfigurable bed sections is smaller than the main bed section.

13. The impaired person care system of claim 12, wherein the lower reconfigurable bed section is additionally movable from an extended position adjacent the middle reconfigurable bed section to a retracted position under the main bed section and vice versa when in its low height setting; and wherein the seat section of the wheelchair is positionable over the mattress of the middle reconfigurable bed section when the middle reconfigurable bed section is in its low height setting and the lower reconfigurable bed section is in its retracted position under the main bed section.

14. The impaired person care system of claim 12, wherein the mattress of the upper reconfigurable bed section is sized to fit within the area encompassed by the rods of the back section rod frame, the mattress of the middle reconfigurable bed section is sized to fit within the area encompassed by the rods of the seat section, and the mattress of the lower reconfigurable bed section is sized to fit within the area encompassed by the rods of the leg section rod frame when the back section and the leg section are in their horizontal lying-down resting position and the mattresses are raised by the lifting mechanisms from their low height setting to their high height setting.

15. The impaired person care system of claim 3, wherein the bottom frame of the upper reconfigurable bed section includes a wheelchair power module connector and wheelchair securing and aligning pins that function to prevent the wheelchair from damaging the power module connector when the wheelchair is being maneuvered over the mattress of the middle reconfigurable bed section.

16. The impaired person care system of claim 15, wherein the frame structure of the wheelchair has lower frame portions, each lower frame portion having an opening for receiving the securing and aligning pins when the wheelchair is positioned over the mattress of the middle reconfigurable bed section.

17. The impaired person care system of claim 16, wherein one of the lower frame portions has an additional opening for receiving the power module connector when the wheelchair is positioned over the mattress of the middle reconfigurable bed section.

18. The impaired person care system of claim 16, wherein each lower frame portion includes a specially configured compartment that houses the locomotion components of the powered wheelchair.

19. The impaired person care system of claim 18, wherein the locomotion components include two batteries, two motors, a steering controller and four wheels attached to a U-shaped bottom plate of the specially configured compartment.

20. The impaired person care system of claim 8, wherein a deadbolt is mounted on a side of the main bed section facing the wheelchair when the wheelchair is positioned over the at least one reconfigurable bed section; and the lower frame portion of the wheelchair facing the main bed section has an opening to allow access of the deadbolt; and wherein the deadbolt, upon being deployed, forces the wheelchair to remain stationary.

21. The impaired person care system of claim 1, wherein the main bed section further includes a bed frame having a contour which prevents the wheelchair from tipping sideways while the wheelchair is configured in the lying-down bed resting position.

22. A method of using an impaired person care system, said method comprising the steps of:

providing a segmented bed having a main bed section and at least one reconfigurable bed section adjacent the main bed section, wherein the main bed section includes a mattress and the at least one reconfigurable bed section includes a mattress and a lifting mechanism for raising the reconfigurable bed section mattress from a low height setting in which the mattress is below the main bed section mattress to a high height setting in which the reconfigurable bed section mattress is substantially commensurate in height with the main bed section mattress;

providing a reconfigurable powered wheelchair including a frame structure, wheelchair locomotion components including wheels, and a patient support area comprising a seat section with a toilet access aperture defined therethrough, a back section rotatably coupled to the seat section, and a leg section rotatably coupled to the seat section; the frame structure being configured to provide an access space of predetermined width and height beneath the seat section and between the wheels free from structural obstacles, and the patient support area being configured to be convertible from an upright sitting position to a horizontal lying-down bed resting position;

maneuvering the wheelchair in the upright sitting position over a standard toilet to position the toilet access aperture in the seat section directly over the toilet;

positioning the access space beneath the seat section of the wheelchair over the mattress and the lifting mechanism of the at least one reconfigurable bed section while the wheelchair is in its upright sitting position and the reconfigurable bed section is in its low height setting;

thereafter, converting the wheelchair from its upright sitting position to its horizontal lying-down bed resting position; and actuating the lifting mechanism to raise both the reconfigurable bed section mattress and the wheelchair to the high height setting.

23. An impaired person care system comprising:

a bed;

a motorized wheelchair;

wherein the wheelchair comprises four wheels, a seat having forward and rear edges, a backrest pivotally engaged at said rear edge about a first pivot axis, and a footrest pivotally engaged at said forward edge about a second pivot axis parallel to said first pivot axis;

wherein said seat has a toilet access aperture defined therethrough;

wherein said backrest is selectively pivotable about said first pivot axis between an upright position extending substantially upward from said first pivot axis and a flat position substantially coplanar with said seat;

wherein said footrest is pivotable about said second pivot axis between a depending position extending substantially downward from said first pivot axis and a flat position substantially coplanar with said seat;

wherein said wheelchair is provided with an open access space beneath said seat sufficiently wide and high to permit the wheelchair to be wheeled into a position with the seat above a standard commode and the toilet access aperture vertically aligned with a bowl of the commode; and means for selectively engaging said bed and wheelchair to one another, wherein said means includes rotational couplers on the bed which are extendable and retractable into and out of engagement with said backrest and footrest to selectively pivot said backrest about said first pivot axis and said footrest about said second pivot axis.

24. The impaired person care system of claim 23, wherein said bed comprises:

a mattress; and a plurality of reconfigurable bed sections each including a mattress, at least one of said reconfigurable bed sections further including a lifting mechanism for selectively positioning the mattress of said at least one reconfigurable bed section from a low height setting at a level below the bed mattress to a high height setting substantially coplanar with the bed mattress;

wherein, when the bed and wheelchair are engaged to one another and the backrest and footrest are in their flat positions, the backrest, seat and footrest rest on the mattresses of the reconfigurable bed sections.

25. The impaired person care system of claim 23, wherein the access space is at least fourteen inches wide and at least fourteen inches high.

26. The impaired person care system of claim 14, wherein the soft, cushioned material defining the sitting and lying-down resting areas in contact with the patient lies directly on and is vertically supported by the mattresses.

* * * * *